US008073352B2

(12) United States Patent
Kunii et al.

(10) Patent No.: US 8,073,352 B2
(45) Date of Patent: Dec. 6, 2011

(54) IMAGE FORMING APPARATUS, AND METHOD OF CONTROLLING WARMING-UP TIME OF IMAGE FORMING APPARATUS

(75) Inventors: Hiroyuki Kunii, Yokohama (JP); Ippei Fijimoto, Yokohama (JP); Hiroshi Yoshinaga, Ichikawa (JP); Toshiharu Hachisuka, Yokohama (JP); Yasunori Ishigaya, Yokohama (JP); Shinichi Namekata, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 482 days.

(21) Appl. No.: 12/339,777

(22) Filed: Dec. 19, 2008

(65) Prior Publication Data

US 2009/0169232 A1 Jul. 2, 2009

(30) Foreign Application Priority Data

Dec. 26, 2007 (JP) ..... 2007-333742
Oct. 1, 2008 (JP) ..... 2008-255917

(51) Int. Cl.
*G03G 15/20* (2006.01)

(52) U.S. Cl. ..... 399/70; 399/69

(58) Field of Classification Search ..... 399/69, 399/70

See application file for complete search history.

(56) References Cited

U.S. PATENT DOCUMENTS 6,577,840 B2 6/2003 Hachisuka et al.
6,628,916 B2 9/2003 Yasui et al.
6,636,709 B2 10/2003 Furukawa et al.
6,778,790 B2 8/2004 Yoshinaga et al.
6,778,804 B2 8/2004 Yoshinaga et al.
6,785,505 B2 8/2004 Yasui et al.
6,865,363 B2 3/2005 Hachisuka et al.
6,881,927 B2 4/2005 Yoshinaga et al.
6,892,044 B2 5/2005 Yasui et al.
6,957,036 B2 10/2005 Kikuchi et al.
7,003,239 B2 * 2/2006 Tanaka ..... 399/69
7,010,257 B2 3/2006 Someya et al.
7,022,944 B2 4/2006 Yoshinaga et al.

(Continued)

FOREIGN PATENT DOCUMENTS

JP 62-70886 4/1987

(Continued)

OTHER PUBLICATIONS

U.S. Appl. No. 12/147,978, filed Jun. 27, 2008, Ippei Fujimoto.

(Continued)

*Primary Examiner* — Hoang Ngo
(74) *Attorney, Agent, or Firm* — Oblon, Spivak, McClelland, Maier & Neustadt, L.L.P.

(57) ABSTRACT

An image forming apparatus includes a fixing unit and a fixing process managing system. The fixing process managing system, including a mode switchover unit, controls a time mode and a temperature mode for heating a fixing member. In the time mode, the fixing unit is determined to be ready for a fixing process when a given time elapses after activation of the image forming apparatus. In the temperature mode, the fixing unit is determined to be ready for a fixing process when a temperature of the fixing member attains a given reference temperature after activation of the image forming apparatus. The mode switchover unit selects between the temperature mode and the time mode. The fixing process managing system selects the temperature mode instead of the time mode when a supply amount of electrical power to the fixing unit is determined to be below a required electrical power supply level.

15 Claims, 14 Drawing Sheets

U.S. PATENT DOCUMENTS

| | | | | |
|---|---|---|---|---|
| 7,127,202 | B2 | 10/2006 | Fujita et al. | |
| 7,127,204 | B2 | 10/2006 | Satoh et al. | |
| 7,139,520 | B2 | 11/2006 | Echigo et al. | |
| 7,151,907 | B2 | 12/2006 | Yoshinaga | |
| 7,177,580 | B2 | 2/2007 | Nakafuji et al. | |
| 7,233,762 | B2 | 6/2007 | Kunii et al. | |
| 7,254,362 | B2 | 8/2007 | Kikuchi et al. | |
| 7,269,384 | B2 | 9/2007 | Someya et al. | |
| 7,299,003 | B2 | 11/2007 | Kurotaka et al. | |
| 7,299,033 | B2 | 11/2007 | Kjellberg et al. | |
| 7,313,353 | B2 | 12/2007 | Satoh et al. | |
| 7,333,760 | B2 | 2/2008 | Baba et al. | |
| 7,359,666 | B2 | 4/2008 | Takashi et al. | |
| 7,369,803 | B2 | 5/2008 | Echigo et al. | |
| 7,379,698 | B2 | 5/2008 | Yoshinaga | |
| 7,395,003 | B2 * | 7/2008 | Dan | 399/70 |
| 7,433,641 | B2 | 10/2008 | Kikuchi et al. | |
| 2005/0158075 | A1 | 7/2005 | Echigo et al. | |
| 2006/0013624 | A1 | 1/2006 | Kurotaka et al. | |
| 2006/0088349 | A1 | 4/2006 | Someya et al. | |
| 2006/0165443 | A1 | 7/2006 | Yoshinaga et al. | |
| 2006/0177232 | A1 | 8/2006 | Ehara et al. | |
| 2006/0257183 | A1 | 11/2006 | Ehara et al. | |
| 2006/0263122 | A1 | 11/2006 | Hachisuka | |
| 2007/0065188 | A1 | 3/2007 | Takagaki et al. | |
| 2007/0104520 | A1 | 5/2007 | Nakafuji et al. | |
| 2008/0063443 | A1 | 3/2008 | Yoshinaga et al. | |
| 2008/0219716 | A1 | 9/2008 | Takashi et al. | |
| 2008/0253789 | A1 | 10/2008 | Yoshinaga et al. | |

FOREIGN PATENT DOCUMENTS

| | | |
|---|---|---|
| JP | 3350315 | 9/2002 |
| JP | 2004-240250 | 8/2004 |
| JP | 2005-17564 | 1/2005 |
| JP | 2005-345989 | 12/2005 |
| JP | 2007-226028 | 9/2007 |

OTHER PUBLICATIONS

Per Client U.S. Appl. No. 12/213,683, filed Jun. 23, 2008, Masanao Ehara.

Per Client U.S. Appl. No. 12/216,292, filed Jul. 2, 2008, Toshiharu Hachisuka.

Per Client U.S. Appl. No. 12/230,857, filed Sep. 5, 2008, Hiroshi Yoshinaga.

Per Client U.S. Appl. No. 12/289,250, filed Oct. 23, 2008, Hiroshi Yoshinaga.

* cited by examiner

IMAGE FORMING APPARATUS, AND METHOD OF CONTROLLING WARMING-UP TIME OF IMAGE FORMING APPARATUS

CROSS-REFERENCE TO RELATED APPLICATIONS

This application claims priority under 35 U.S.C. 119(a) to Japanese Patent Application Nos. 2007-333742, filed on Dec. 26, 2007, and 2008-255917, filed on Oct. 1, 2008 in the Japan Patent Office, the entire contents of each of which are hereby incorporated by reference herein.

BACKGROUND OF THE INVENTION

1. Field of the Invention

The present disclosure generally relates to a fixing unit of an image forming apparatus, and more particularly to a method of controlling a warming-up time of a fixing unit of the image forming apparatus.

2. Description of the Background Art

Image forming apparatuses using electrophotography may record an image on a recording medium using a procedure like the following: A rotating photoconductor, such as a photoconductor drum or a photoconductor belt, is charged by a charger; an electrostatic latent image is formed on the photoconductor by directing light onto the photoconductor; the electrostatic latent image is developed as a toner image by a development unit; the toner image is transferred to a recording medium (e.g., sheet, film, etc.) directly, or indirectly via an intermediate transfer member; the toner image is fixed on the recording medium by a fixing unit.

Such a fixing unit may include a fixing member and a pressing member setting a fixing nip therebetween, in which the pressing member presses against the heated fixing member. The recording medium is passed through the fixing nip to melt the toner with heat and fix the toner on the recording medium with pressure. The fixing member may be a fixing roller or a fixing belt provided with a heat source, such as a halogen heater or an induced heating coil (IH coil), used for heating the fixing member. The fixing roller may include the heat source inside the roller. The fixing belt may include the heat source in a roller used for extending the fixing belt, or around the fixing belt.

To save energy, the heat source may be de-energized (e.g., power supply is OFF) during a standby time (i.e., when an image forming process is not conducted). When the image forming process is resumed, the heat source is energized (e.g., power supply is ON) to heat the fixing member to a desired fixing temperature to prevent a fixing failure. Fixing process can be conducted most effectively at the desired fixing temperature.

The time required for heating the fixing member to the desired fixing temperature may be referred as a warming-up time. The warming-up time may be determined by a temperature mode, which determines a time that the fixing process can be conducted effectively based on a detection of actual temperature of the fixing member.

FIG. 1 shows example time-to-temperature profiles of the fixing member relative to the warming-up time for the fixing member. For example, in case of a line "a" of FIG. 1, the temperature of the fixing member reaches a designed fixing temperature Tf (e.g., 180 degrees Celcius) at a time tw (e.g., 30 seconds), and then it is determined that the fixing process can be conducted effectively at the time "tw" and after, and the power supply to the heat source is stopped.

However, a user may feel inconvenience and frustration with such a configuration using the temperature mode because the warming-up time may fluctuate in a given time range. For example, the warming-up time may fluctuate in a time range L as shown by a dot line "b" and a dot line "c" of FIG. 1.

In light of such fluctuation of the warming-up time using the temperature mode, a time mode may be employed for determining that the fixing process can be conducted effectively. In the time mode, it is determined that the fixing process can be conducted when the given time tw (e.g., 30 seconds) elapses after energizing the fixing member. Accordingly, in the time mode, the warming-up time can be set to a substantially constant value. Such warming-up time set by the time mode may be described as a feature of a product like "This machine can be ready for printing in a waiting time of "xx" seconds." Although a fixing temperature of the fixing member may vary when the time mode is employed, such variation of the fixing temperature may not become a problem and the warming-up time can be set to a constant value.

Such conventional art can be found in JP-2005-345989-A, JP-3350315-B, JP-S62-70886-A, and JP-2004-240250-A, for example.

However, the time mode may have some drawbacks in some cases. For example, if the heat source is not supplied with enough electric power from a power source, the temperature of the fixing member may not reach the designed fixing temperature Tf at the warming-up time tw set by the time mode (see the broken line d of FIG. 1). Such a situation may occur when an input voltage to the heat source for some reason decreases. Because the time mode determines a start of fixing process using the time tw (see FIG. 1), the temperature of the fixing member may follow a temperature profile of the broken line "d" until "tw" and then the dotted line "e" when a sheet is fed to the fixing unit. Then the temperature of the fixing member becomes lower than a minimum fixing temperature Tm (e.g., 155 degrees Celcius), and thereby a fixing failure may occur.

There are several instances in which the heat source of the image forming apparatus might not get enough power to warm up the fixing member to the designated fixing temperature, such as when peripheral units are connected to the image forming apparatus or when the image forming apparatus needs to undergo an image adjustment operation. Both cases are described in detail below.

In general, the image forming apparatus may be connected to one or more peripheral units (e.g., a finisher, n automatic document feeder), and the image forming apparatus and the peripheral unit may be powered by a single power source. In such a system configuration, activation of the fixing unit may be conducted simultaneously with initialization of the peripheral unit, wherein the initialization may include resetting of a moving part to its home position in the peripheral unit, for example.

Accordingly, electrical power sufficient for the fixing process may not be supplied to the heat source from the single power source because the same single power source needs to supply electrical power used for initialization of the peripheral unit, by which the heat source may not generate sufficient heat energy for heating the fixing member. Accordingly, if the time mode is employed for the image forming apparatus that is connected to the peripheral unit, the temperature of the fixing member may not be increased to the desired fixing temperature using the time mode, by which a fixing failure may occur.

Further, an image forming apparatus may need an image adjustment operation when the image forming apparatus is activated after leaving the image forming apparatus in an un-used condition for a given time period or when a sensor value read by an environment sensor changes greatly because imaging condition (e.g., toner concentration, image writing timing) may change. To maintain an image quality at a higher quality level, the image adjustment operation (e.g., image concentration adjustment operation, color-position displacement correction of image forming engine) may be conducted when the image forming apparatus is activated. Accordingly, electrical power sufficient for the fixing process may not be supplied to the heat source from the single power source because the same single power source need to supply electrical power used for the image adjustment operation, by which the heat source may not generate sufficient heat energy for heating the fixing member. Accordingly, if the time mode is employed for the image forming apparatus which needs the image adjustment operation, the temperature of the fixing member may not be increased to the desired fixing temperature, by which a fixing failure may occur.

SUMMARY

An image forming apparatus includes a fixing unit and a fixing process managing system. The fixing unit includes a fixing member and a pressing member pressed against the fixing member. A recording medium is passed through a space between the fixing member and the pressing member to fix a toner image on the recording medium by applying heat and pressure using the fixing member and the pressing member. The fixing process managing system, including a mode switchover unit, controls a time mode and a temperature mode for heating the fixing member. In the time mode, the fixing unit is determined to be ready for a fixing process when a given time elapses after activation of the image forming apparatus. In the temperature mode, the fixing unit is determined to be ready for a fixing process when a temperature of the fixing member attains a given reference temperature after activation of the image forming apparatus. The mode switchover unit selects between the temperature mode and the time mode for the fixing unit. The fixing process managing system selects the temperature mode instead of the time mode when a supply amount of electrical power to be supplied to the fixing unit when activating the image forming apparatus is determined to have become smaller than a required level of electrical power supply.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
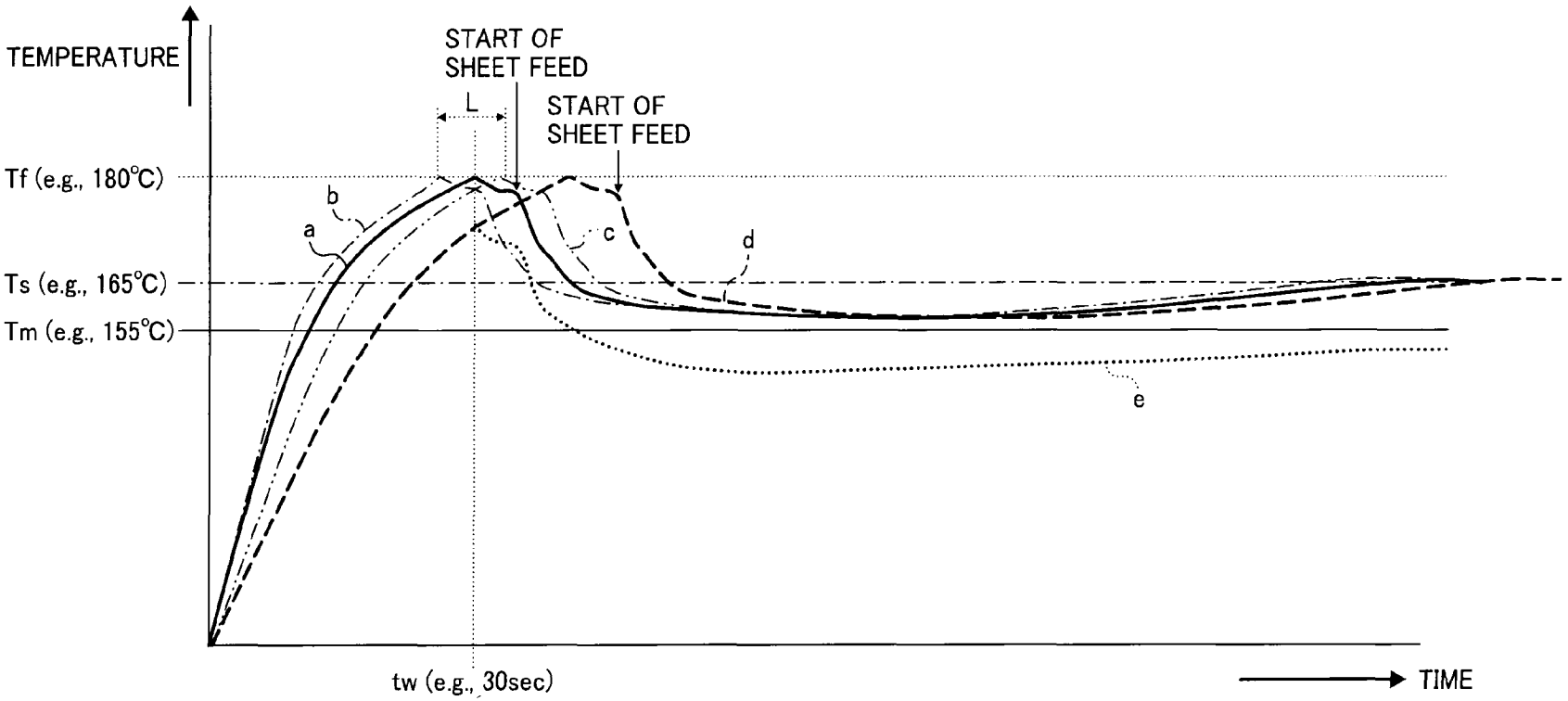
FIG. 1 illustrates a time-to-temperature profile of a conventional fixing unit.

The accompanying drawings are intended to depict example embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Figure 2:
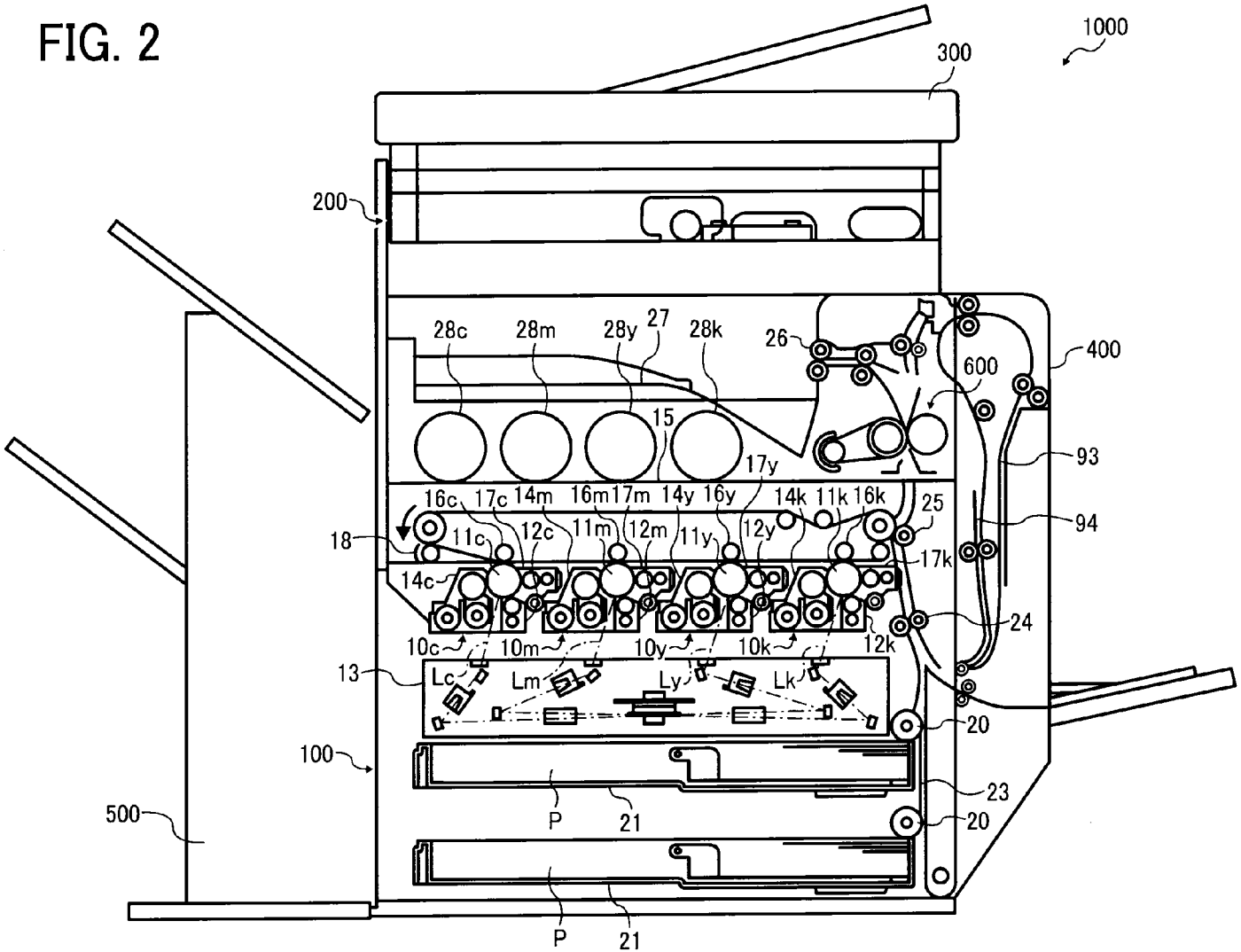
FIG. 2 illustrates a schematic configuration of an image forming apparatus according to an exemplary embodiment.

Referring now to FIG. 2, an image forming apparatus according to an example embodiment is described with reference to accompanying drawings. The image forming apparatus may employ electrophotography, for example, and may be used as a copier, a printer, a facsimile, or a multi-functional apparatus, but not limited thereto.

FIG. 2 illustrates a schematic configuration of an image forming system 1000 according to an example embodiment. The image forming system 1000 may be a color copier including a tandem arrangement, but not limited to thereto.

As shown in FIG. 2, the image forming system 1000 includes an image forming unit 100, an image scanner 200, an automatic document feeder 300 (ADF 300), an inverting unit 400, and a finisher 500, for example. The image scanner 200 may be disposed at an upper part of the image forming unit 100. The ADF 300 may be disposed over the image scanner 200. The inverting unit 400 may be disposed on one side of the image forming unit 100, and the finisher 500 may be disposed on another side of the image forming unit 100.

The image forming unit 100 includes image forming engines 10*c*, 10*m*, 10*y*, and 10*k* arranged in a tandem manner. In this disclosure, suffix letters of "c, m, y, k" may represent "cyan, magenta, yellow, and black." Each of the image forming engines 10*c*, 10*m*, 10*y*, and 10*k* includes photoconductors 11*c*, 11*m*, 11*y*, and 11*k*, respectively. The photoconductor 11 may have a drum shape and used as an image carrier.

When the photoconductors 11*c*, 11*m*, 11*y*, and 11*k* rotate in a clockwise direction in FIG. 2, surfaces of the photoconductors 11*c*, 11*m*, 11*y*, and 11*k* are uniformly charged by charge units 12*c*, 12*m*, 12*y*, and 12*k* respectively by an bias voltage applied from the charge unit 12 (e.g., a charge roller). Then, an image writing unit 13 emits laser beams Lc, Lm, Ly, Lk to the photoconductors 11*c*, 11*m*, 11*y*, and 11*k* to write an electrostatic latent image on each of the photoconductors 11*c*, 11*m*, 11*y*, and 11*k*, in which the laser beams Lc, Lm, Ly, and Lk are generated based on image information scanned by the image scanner 200. Instead of using the laser beams, the image writing unit 13 may use an light emitting diode array (LED array) to write an electrostatic latent image.

The electrostatic latent image is then developed as a visible image (e.g., toner image) by development units 14*c*, 14*m*, 14*y*, and 14*k* for each of the photoconductors 11*c*, 11*m*, 11*y*, and 11*k*, by which a single color image can be formed on each of the photoconductors 11*c*, 11*m*, 11*y*, and 11*k*. In such a development process, toner particles are attracted to the electrostatic latent images formed on the photoconductors 11*c*, 11*m*, 11*y*, and 11*k*.

Further, the image forming unit 100 includes an intermediate transfer member 15, which can contact the photoconductors 11*c*, 11*m*, 11*y*, and 11*k* and travel in a counter-clockwise direction in FIG. 2. The intermediate transfer member 15 may be an endless belt.

The single color images are sequentially transferred from the photoconductors 11*c*, 11*m*, 11*y*, and 11*k* onto the intermediate transfer member 15 by using primary transfer units 16*c*, 16*m*, 16*y*, and 16*k* so as to form a full color image on the intermediate transfer member 15 (i.e., primary transfer process). In such primary transfer process, a plurality of single color images are superimposed each another in a given color order, such as for example in an order of cyan, magenta, yellow, and black.

Meanwhile, a sheet feed roller 20 is rotated to feed a recording medium P from a sheet cassette 21 to a registration roller(s) 24 through a feed route 23 at a given time, and the recording medium P is stopped at the registration roller 24. When the full color image is formed on the intermediate transfer member 15, the registration roller 24 is rotated to feed the recording medium P to a secondary transfer area set by a secondary transfer unit 25 and the intermediate transfer member 15, by which the full color image is transferred onto the recording medium P from the intermediate transfer member 15 (i.e., secondary transfer process).

The recording medium P is then transport to a fixing unit 600 along the feed route 23. In the fixing unit 600, the full color image is fixed on the recording medium P when the recording medium P passes a fixing nip N, and then ejected by an ejection roller 26 and stacked on an ejection stack 27 of the image forming unit 100.

After the primary transfer process, the photoconductors 11*c*, 11*m*, 11*y*, and 11*k* are cleaned by primary cleaning units 17*c*, 17*m*, 17*y*, and 17*k* to remove toner from the photoconductor 11 to prepare for a next image forming process. After the secondary transfer process, the intermediate transfer member 15 is cleaned by a secondary cleaning unit 18 to remove toner from the intermediate transfer member 15 to prepare for a next image forming process.

The image forming unit 100 further includes toner bottles 28*c*, 28*m*, 28Y, and 28*k* for each of color toner to be supplied to the development units 14*c*, 14*m*, 14*y*, 14*k* using a transport device.

The image forming unit 100 can record images on both faces of the recording medium P by using the inverting unit 400. For example, after one image is fixed on one face of the recording medium P in the fixing unit 600, the recording medium P is transported to the inverting unit 400 using a switch claw, which changes sheet route to a switchback route 93. The recording medium P is switch backed into the switchback route 93 to invert its faces, and then fed to the secondary transfer area from a re-entry route 94. At the secondary transfer area, another image formed on the intermediate transfer member 15 is transferred on the other face of recording medium P, fixed in the fixing unit 600, and then ejected to the ejection stack 27 by the ejection roller 26.

Although the above description is for a full color image process by the image forming unit 100, the image forming unit 100 can be used to form a monochrome image and other color image on the recording medium P in addition to a full color image. For example, the image forming unit 100 may include a single color mode or a multi-color mode, in which at least one of the image forming engines 10*c*, 10*m*, 10*y*, and 10*k* is selected for an image forming process to form a monochrome image or a multi-color image.

In the image forming system 1000, the image forming unit 100 may be coupled with one or more peripheral units, such as for example the finisher 500, and the ADF 300; The finisher 500 is used to process printed sheets, such as stacking printed sheets in a sorted manner or binding a given volume of sheets by a stapler; the ADF 300 transports document to the image scanner 200 automatically. Such peripheral unit may be coupled to the image forming unit 100 and may be operated by supplying power from a power source and control signals. For example, the image forming unit 100 and the peripheral unit may be connected to a same power source. Such peripheral unit may have many variations depending on customer needs, and such peripheral unit may or may not be coupled to the image forming unit 100 depending on usage condition or environment. In the following exemplary embodiments, the image forming unit 100 may be coupled with one or more peripheral units, and the term of peripheral unit may include both singular and plural peripheral units.

When the image forming unit 100 and the peripheral unit (e.g., finisher 500, ADF 300) coupled together as the image forming system 1000 as shown in FIG. 2, and the image forming unit 100 and the peripheral unit are connected to a single power source, and both of the image forming unit 100 and the peripheral unit may be activated by the single power source, an initialization process of the peripheral unit may be conducted when an activation process of the fixing unit 600 in the image forming unit 100 is conducted.

The initialization process may be a process of setting movable parts in the peripheral unit to a home position wherein the single power source supplies a given electric power for the initialization process.

Because of such initialization process of the peripheral unit, the fixing unit 600 may not be supplied with sufficient electric power from the single power source when the activation process of the fixing unit 600 is conducted. For example, the fixing unit 600 may be supplied with an electric power, which is lower than a normal electric power required for a fixing process, by which a heat source cannot produce enough heat energy for the fixing process.

Figure 3:
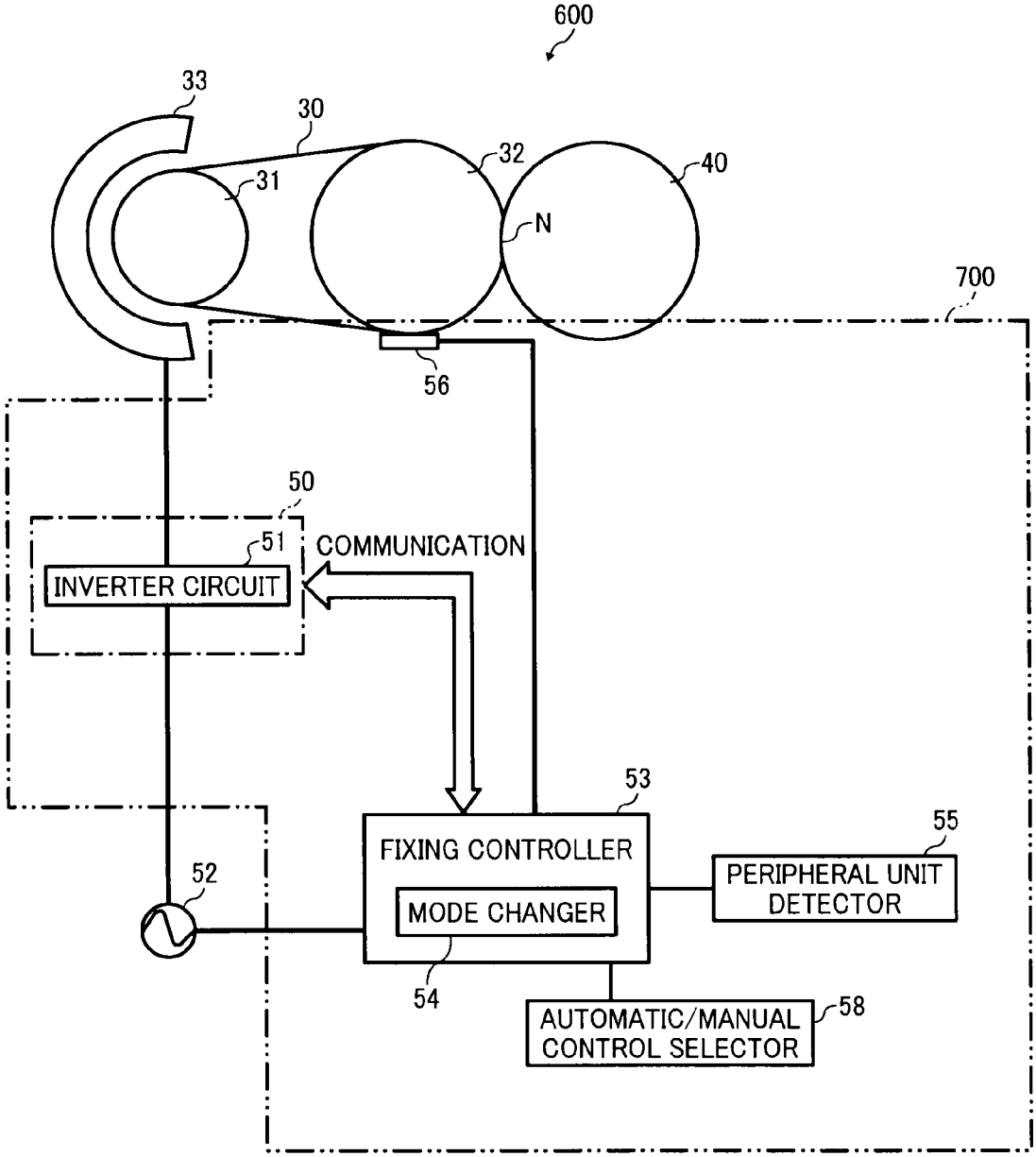
FIG. 3 illustrates a schematic configuration of a fixing unit and a fixing process managing unit of the image forming unit of FIG. 2.

A description is now given of a first example of a fixing process management system 700 for the fixing unit 600 used in the image forming unit 100 with reference to FIG. 3.

The fixing unit 600 includes a fixing belt 30, a first roller 31, a second roller 32, a heat source 33, and a pressure roller 40, for example. The fixing belt 30 is extended by the first roller 31 and the second roller 32, wherein a drive unit can rotate one of the first roller 31 and second roller 32. In such a configuration, the fixing belt 30 can be rotated by rotating the first and second rollers 31 and 32. The heat source 33 may be disposed around the first roller 31 to heat the fixing belt 30, and the pressure roller 40 may be pressed against the second roller 32 via the fixing belt 30 to form the fixing nip N. The heat source 33 may be an induction heat coil (IH coil) using electromagnetic induction, for example, but not limited thereto.

When the recording medium P having an unfixed image thereon passes the fixing nip N, the recording medium P is applied with pressure by the pressure roller 40, the fixing belt 30, and the second roller 32, and also applied with heat energy by the fixing belt 30 heated by the heat source 33. With such a fixing configuration, the unfixed image can be fixed on the recording medium P. When electric current is supplied to the IH coil of the heat source 33, the fixing belt 30 is heated by electromagnetic induction.

The fixing process management system 700 can be used to control the heat source 33 of the fixing unit 600. The fixing process management system 700 includes an IH controller 50, a fixing controller 53, and a peripheral unit detector 55, for example. The IH controller 50 including an inverter circuit 51 is connected to the heat source 33. The fixing controller 53 including a mode changer 54 is connected to the peripheral unit detector 55. The mode changer 54 is used to change a heating mode between temperature/time mode, therefore, the mode changer 54 may be called as temperature/time mode switchover unit. The peripheral unit detector 55 detects whether a peripheral unit (e.g., finisher 500, ADF 300) is connected or disconnected using electrical signal. The IH controller 50 is connected to the fixing controller 53 for communicating information each other.

Based on a detection result of the peripheral unit detector 55, the mode changer 54 selects one of a "temperature mode" and a "time mode" when the activation process of the fixing unit 600 is conducted to set the temperature of the fixing belt 30 to a fixing temperature. The fixing belt 30 is used as a fixing member.

In the "temperature mode," it is determined that a fixing process can be effectively conducted when the temperature of the fixing belt 30 becomes a given temperature value. For example, when the temperature of the fixing belt 30 is increased to a designed fixing temperature, it is determined that a fixing process can be effectively conducted.

In "time mode," it is determined that a fixing process can be effectively conducted when a given time lapses after the activation process of the fixing unit 600 is started.

The fixing controller 53 is further connected to a thermistor 56 and an automatic/manual control selector 58. The thermistor 56 detects the temperature of the fixing belt 30 used as a fixing member. The automatic/manual control selector 58 is used to select an automatic control or a manual control of the heat source 33 of the fixing unit 600. Further, the fixing controller 53 and the IH controller 50 are connected to a commercial power source 52.

The fixing process management system 700 controls the heating mode of the fixing belt 30 heated by the heat source 33 of the fixing unit 600. The fixing process management system 700 may set the "time mode" as a first priority mode and the "temperature mode" as a second priority mode, in which the "time mode" is used as a standard mode for the heating mode. However, if it is determined that the "time mode" may cause a fixing failure, the mode changer 54 changes the heating mode from the "time mode" to the "temperature mode." For example, if it is determined that an electric power supply to the fixing unit 600 becomes lower than a desired power supply for the activation process of the fixing unit 600, the heating mode is changed to the "temperature mode" from the "time mode."

With such a configuration, the fixing process management system 700 can employ the "time mode" as a primary mode for controlling a warming-up time of the fixing unit 600. In the "time mode," the warming-up time of the fixing unit 600 is set to a given constant time, which may be determined by experiments or the like.

However, in the "time mode," depending on a connection status of the peripheral unit, the fixing unit 600 may not be supplied with electrical power sufficient for a fixing process from the single power source because the same single power source supplies electrical power used for the initialization process of the peripheral unit.

For example, when the "time mode" having a constant warming-up time "tw" (see FIG. 1) is employed in the above described situation having the peripheral unit, it is determined that a fixing process can be conducted even if the actual temperature of the fixing belt 30 is lower than a designed fixing temperature Tf at the time "tw" (see dot line "d" in FIG. 1). In such a situation, the temperature of the fixing belt 30 may become lower than a minimum fixing temperature Tm (e.g., 155 degrees Celcius) after the time "tw" when sheets are fed in the fixing nip N (see a dot line e in FIG. 1), by which a fixing failure may occur.

In view of such situation that the peripheral unit is connected to the image forming unit 100, and thereby the fixing unit 600 may not be supplied with electrical power sufficient for a fixing process from the single power source when the activation process of the fixing unit 600 is conducted, the "time mode," which can set a waiting time of user at a substantially constant value, is canceled because the heat source 33 may not generate heat energy sufficient to heat the fixing belt 30.

For example, if it determined that the fixing unit 600 may not be supplied with electrical power sufficient for a fixing process (e.g., 1200 W) but may be supplied with reduced electrical power, such as 10% down power (e.g., 1080 W or less), the "time mode" is canceled, by which a waiting time of a user may not be maintained at a constant value. In such a case, instead of the "time mode," the "temperature mode" is employed in which it is determined that a fixing process can be conducted when the temperature of the fixing belt 30 becomes the designed fixing temperature Tf required for the fixing process. With such a configuration, a fixing failure, caused by a temperature drop of the fixing belt 30 compared to the designed fixing temperature Tf, can be prevented.

Figure 4:
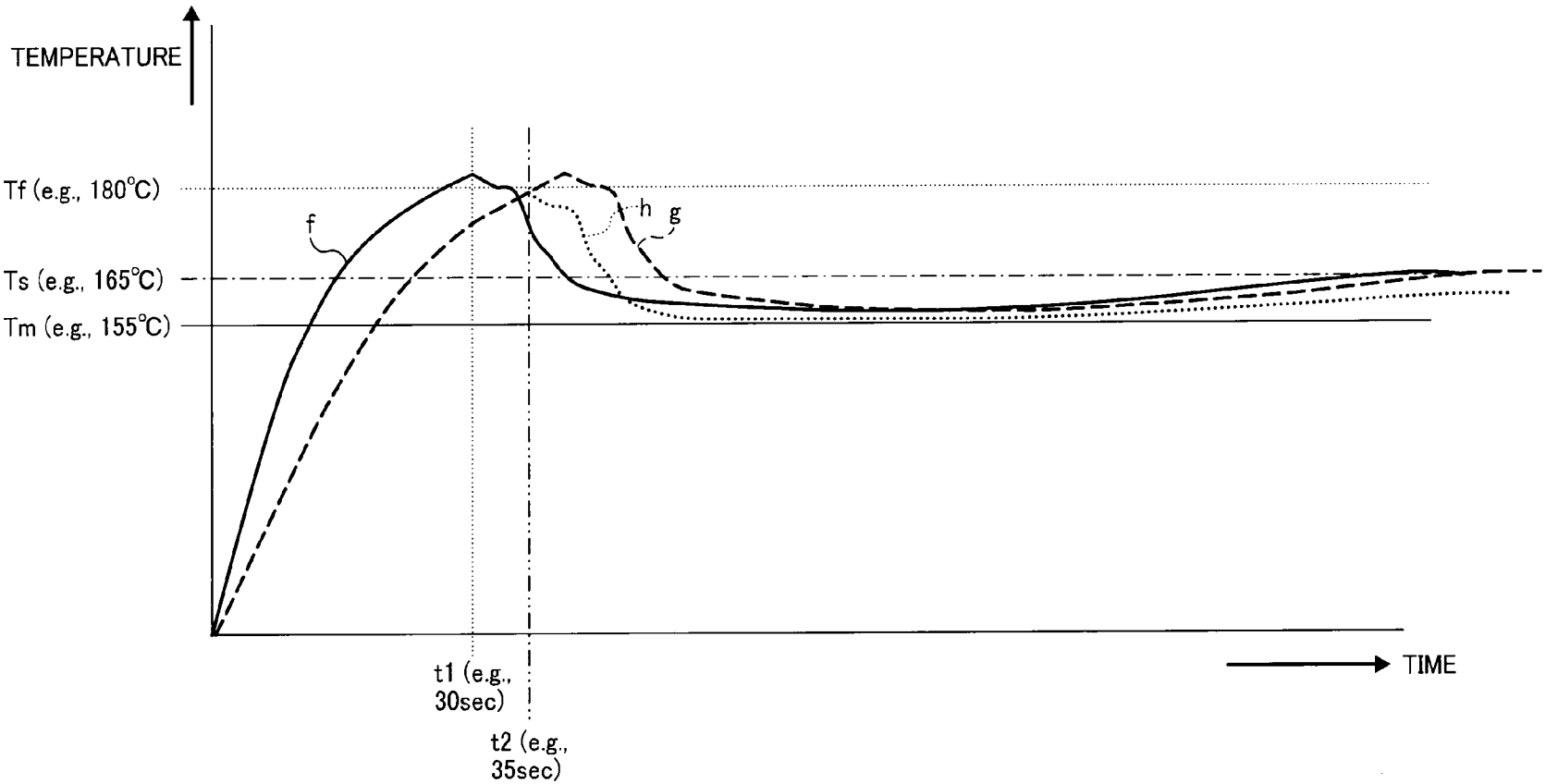
FIG. 4 illustrates time-to-temperature profiles of the fixing unit of FIG. 3.

FIG. 4 shows example time-to-temperature profiles of the fixing unit 600, in which the "time mode" is shown by a line "f" and the "temperature mode" is shown by a dot line "g."

As shown by the line "f," in the "time mode," it is determined that a fixing process can be conducted when a given time t1 (e.g., 30 seconds) elapses after starting the activation process of the fixing unit 600.

As shown by the dot line "g," when a peripheral unit is connected to the image forming apparatus 100, the fixing process management system 700 changes the heating mode from the "time mode" to the "temperature mode," in which it is determined that a fixing process can be conducted when the temperature of the fixing belt 30 becomes the designed fixing temperature Tf (e.g., 180 Degrees Celcius).

The "time mode" and "temperature mode" may be selectively used to reduce waiting time of a user so that the user may not need to wait a start-up of the image forming apparatus 100 unnecessarily.

For example, when the "time mode" is used in a condition that the temperature of the fixing belt 30 can become the designed fixing temperature Tf before the given time t1 elapses, a user may unnecessarily wait a start-up of the image forming apparatus 100 even if the fixing belt 30 is ready for a fixing process before the given time t1 elapses. Such a situation may occur when the temperature of the fixing belt 30 is still at a higher temperature because the time from the previous fixing process is short to decrease the temperature of the fixing belt 30. In such a case, the "temperature mode" is employed so that the user may not unnecessarily wait the activation process of the fixing unit 600.

Figure 5:
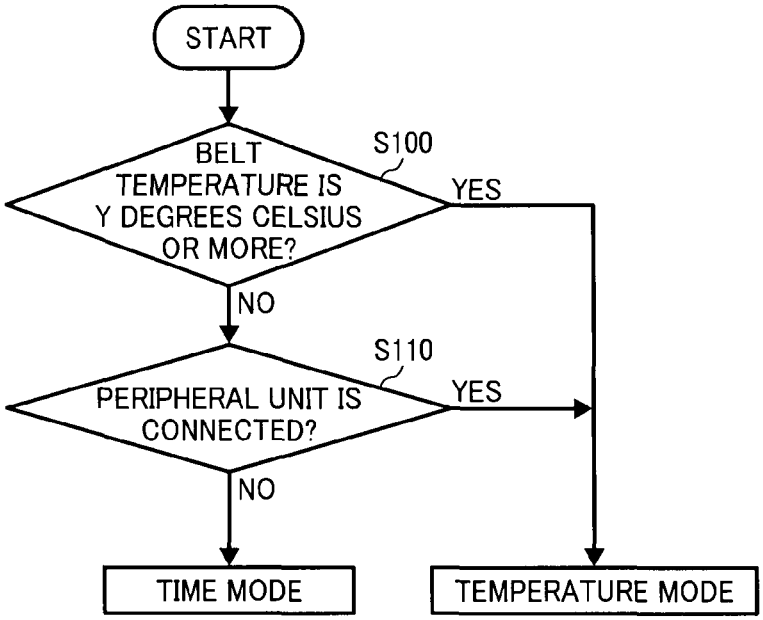
FIG. 5 shows one example flow chart for a method of controlling a warming-up time of the fixing unit of FIG. 3.

FIG. 5 shows one example flow chart for a method of controlling the warming-up time of the fixing unit 600. In the method shown in FIG. 5, the belt temperature of the fixing belt 30 is compared with a given reference temperature Y degrees Celcius (e.g., 50 degrees Celcius) at first (step S100). If the belt temperature is at the given reference temperature Y degrees Celcius or more (Yes at step S100), the heating mode is changed or switched to the "temperature mode." The reference temperature may be determined by experiments of the like, for example.

If the belt temperature is below the given reference temperature Y degrees Celcius (No at step S100), it is checked whether a peripheral unit (e.g., finisher 500, ADF 300) is connected to the image forming apparatus 100 by using the peripheral unit detector 55 (step S110). If the peripheral unit is connected to the image forming apparatus 100 (Yes at step S110), the "temperature mode" is set, and if the peripheral unit is not connected to the image forming apparatus 100 (No at step S110), the "time mode" is set. In step S110, the mode changer 54 changes the heating mode based on a detection result obtained by the peripheral unit detector 55.

In the above described process of FIG. 5, the fixing process management system 700 determines a connection status whether a peripheral unit is connected or not to the image forming unit 100 based on a detection result obtained by the peripheral unit detector 55, and then determines whether electrical power to be supplied to the fixing unit 600 becomes lower than a desired electrical power when the activation process of the fixing unit 600 is to be conducted. Accordingly, information of the existence or non-existence of connected peripheral unit is used.

However, another information related to connection status of peripheral unit can be used when the fixing process management system 700 can determine whether electrical power to be supplied to the fixing unit 600 becomes lower than a desired electrical power when the activation process of the fixing unit 600 is to be conducted.

For example, information of type(s) and/or number(s) of peripheral unit connected to the image forming unit 100 can be used to determine the connection status of peripheral unit. Based on the connection status of peripheral unit, the fixing process management system 700 can determine whether electrical power to be supplied to the fixing unit 600 becomes lower than a desired electrical power when the activation process of the fixing unit 600 is to be conducted.

Further, the fixing process management system 700 can determine the connection status of peripheral unit based on a total electric power consumption of peripheral unit connected to the image forming unit 100. In such a case, a peripheral unit table including unit identification information (e.g., unit ID) and electrical power information of peripheral unit connected to the image forming unit 100 may be prepared, and total electric power consumption of peripheral unit actually connected to the image forming unit 100 can be computed using the peripheral unit table. Such method may be preferably used when the peripheral unit requires a smaller electrical power for operation because if the electrical power used for the peripheral unit is smaller than a given value, the activation process of the fixing unit 600 can be conducted without considering the power consumption of peripheral unit. The total electric power consumption of peripheral unit can be computed by adding or accumulating electric power consumption for each peripheral unit. Accordingly, the total electric power consumption of peripheral unit may be termed accumulated electric power consumption of peripheral unit.

Figure 6:
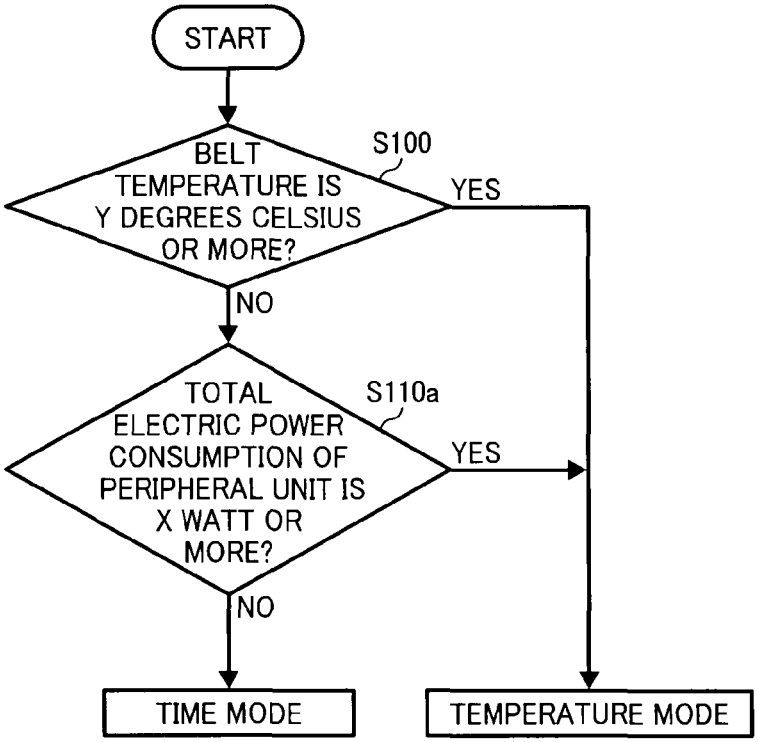
FIG. 6 shows another example flow chart for a method of controlling a warming-up time of the fixing unit of FIG. 3.

FIG. 6 shows another example flow chart for another method of controlling the warming-up time of the fixing unit 600 using information of the total (or accumulated) electric power consumption of peripheral unit connected to the image forming unit 100.

In the method of FIG. 6, the belt temperature of the fixing belt 30 is compared with a given reference temperature Y degrees Celcius (e.g., 50 degrees Celcius) at first (step S100). If the belt temperature is the given reference temperature Y or more (Yes at step S100), the heating mode is changed to the "temperature mode."

If the belt temperature is below the given reference temperature Y degrees Celcius (No at step S100), it is checked whether the total electric power consumption of peripheral unit connected to the image forming unit 100 is a given reference electrical power (e.g., X watt) or more (step S110*a*).

If the total electric power consumption is the given reference electrical power "X watt" or more (Yes at step S110*a*), the "temperature mode" is set, and if the total electric power consumption is less than the given reference electrical power "X watt" (No at step S110*a*), the "time mode" is set so that a user may not unnecessarily wait the start-up of the image forming apparatus 100. Accordingly, when the total electric power consumption of peripheral unit becomes a greater value, the "temperature mode" is employed so that a fixing failure, caused by insufficient heat power of the heat source 33, can be prevented.

Figure 7:
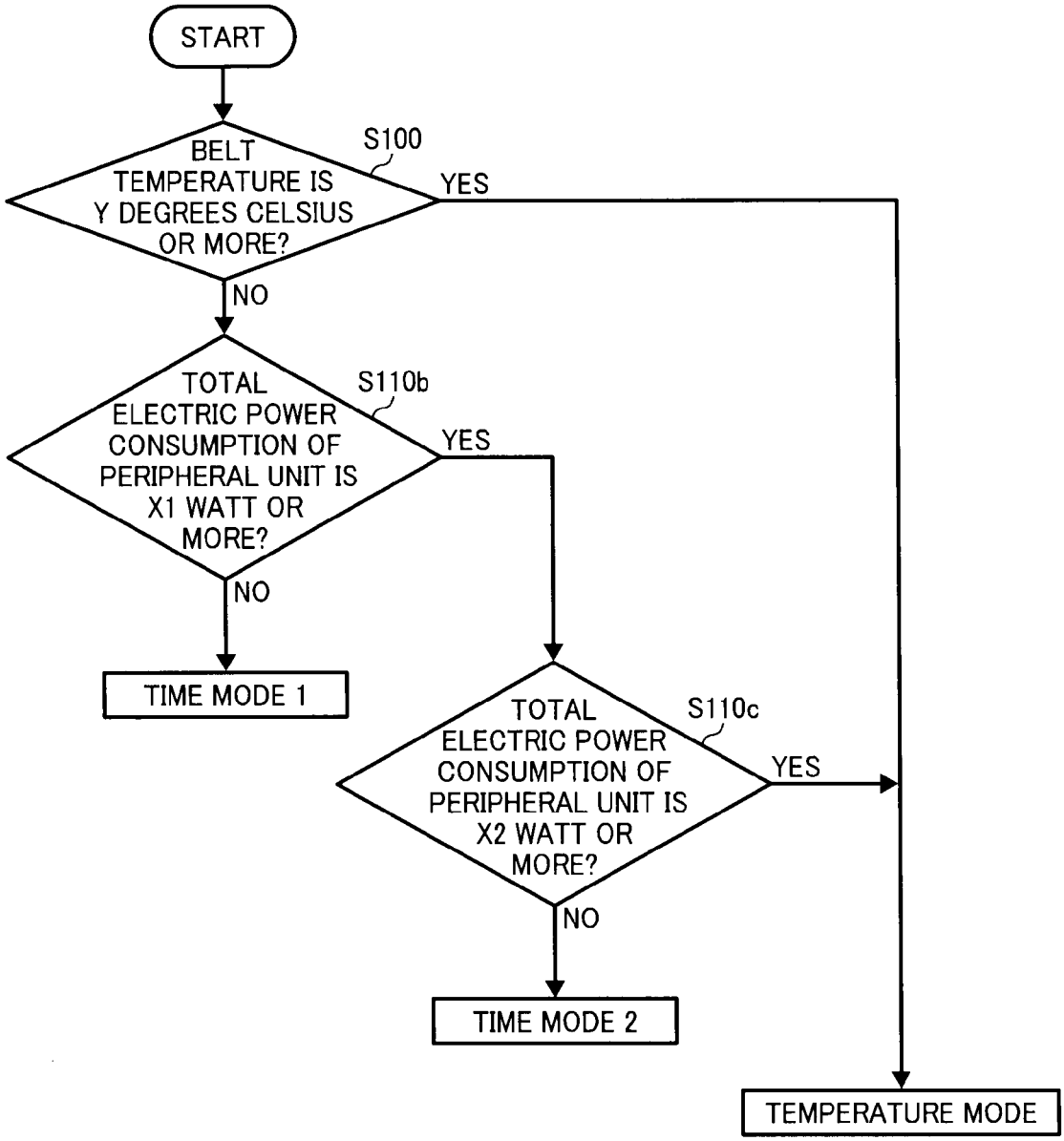
FIG. 7 shows another example flow chart for a method of controlling a warming-up time of the fixing unit of FIG. 3.

FIG. 7 shows another example flow chart for another method of controlling the warming-up time of the fixing unit 600 using information of a total electric power consumption of peripheral unit connected to the image forming unit 100. Each of the peripheral units connected to the image forming unit 100 may be different types of apparatuses and require different level of electrical power. Such apparatus type and electrical power information can be prepared as a peripheral unit table.

In the method of FIG. 7, the belt temperature of the fixing belt 30 is compared with a given reference temperature Y degrees Celcius (e.g., 50 degrees Celcius) at first (step S100). If the belt temperature is the given reference temperature Y degrees Celcius or more (Yes at step S100), the heating mode is changed to the "temperature mode."

If the belt temperature is below the given reference temperature Y degrees Celcius (No at step S100), it is checked whether the total electric power consumption of peripheral unit connected to the image forming unit 100 is a first level of electrical power (e.g., X1 watt) or more (step S110*b*). The above mentioned peripheral unit table can be used to compute the total electric power consumption of peripheral unit.

If the total electric power consumption is less than the first level of electrical power "X1 watt" (No at step S110*b*), the "time mode 1" is set.

If the total electric power consumption is the first level of electrical power "X1 watt" or more (Yes at step S110*b*), it is checked whether the total electric power consumption of peripheral unit is a second level of electrical power (e.g., X2 watt) or more (step S110*c*). The second level of electrical power "X2 watt" may be set higher than the first level of electrical power "X1 watt."

If the total electric power consumption is less than the second level of electrical power "X2 watt" (No at step S110*c*), the "time mode 2" is set. The "time mode 2" may be set with a time longer than a time set for the "time mode 1."

If the total electric power consumption is the second level of electrical power "X2 Watt" or more (Yes at step S110*c*), the "temperature mode" is set.

As such, the fixing process management system 700 can control a given reference time used for the "time mode" based on connection status of peripheral unit connected to the image forming unit 100. Specifically, the fixing process management system 700 can set a plurality of waiting times (e.g., two waiting times) based on the number and/or types of the connected peripheral unit, by which a user may not need to unnecessarily wait the start-up of the image forming apparatus 100.

FIG. 4 can be used to explain the difference of the above-described plurality of waiting times (e.g., two waiting times). In FIG. 4, a given reference time t1 is set for "time mode 1" and a given reference time t2 is set for the "time mode 2," in which the given reference time t2 is set longer than the given reference time t1. With such a configuration, the waiting time can be step-wisely controlled for the "time mode" based on information of the total electric power consumption of the connected peripheral unit. Such a method can set a relatively wider time range while reducing a variation of warming-up time of the fixing unit 600.

With such a temperature control, a fixing failure caused by a temperature drop of the fixing belt 30 compared to the designed fixing temperature Tf can be prevented (see dot line "h" in FIG. 4).

Figure 8:
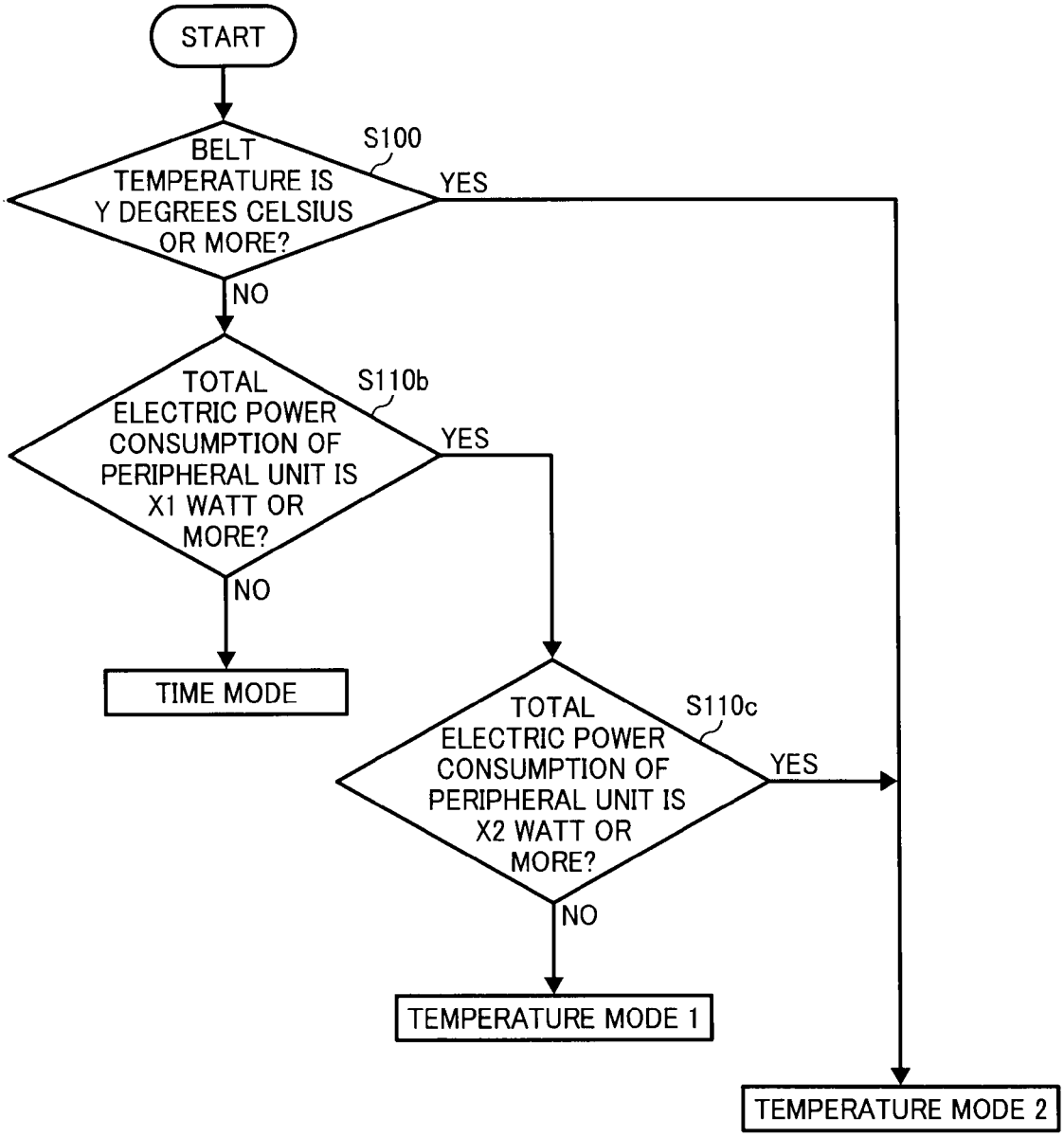
FIG. 8 shows another example flow chart for a method of controlling a warming-up time of the fixing unit of FIG. 3.

FIG. 8 shows another example flow chart for another method of controlling the warming-up time of the fixing unit 600 using information of a total electric power consumption of peripheral unit connected to the image forming unit 100.

Each of the peripheral units connected to the image forming unit 100 may be different types of apparatuses and require different level of electrical power. Information of apparatus type and electrical power used for apparatus can be prepared as a peripheral unit table and stored.

In the method of FIG. 8, the belt temperature of the fixing belt 30 is compared with a given reference temperature Y degrees Celcius (e.g., 50 degrees Celcius) at first (step S100).

If the belt temperature is less than the given reference temperature Y degrees Celcius (No at step S100), it is checked whether the total electric power consumption of peripheral unit connected to the image forming unit 100 is first level of electrical power (e.g., X1 Watt) or more (step S110*b*). The total electric power consumption of peripheral unit can be computed using the peripheral unit table.

If the total electric power consumption is less than the first level of electrical power "X1 watt" (No at step S110*b*), the "time mode" is set.

If the total electric power consumption is the first level of electrical power "X1 watt" or more (Yes at step S110*b*), it is checked whether the total electric power consumption of peripheral unit connected to the image forming unit 100 is a second level of electrical power (e.g., X2 watt) or more (step S110*c*). The second level of electrical power "X2 watt" may be set higher than the first level of electrical power "X1 watt."

If the total electric power consumption is less than the second level of electrical power "X2 watt" (No at step S110*c*), the "temperature mode 1" setting a first target temperature is set.

If the total electric power consumption is the second level of electrical power "X2 watt" or more (Yes at step S110*c*), the "temperature mode 2" setting a second target temperature is set.

In such a configuration, the second target temperature is set higher than the first target temperature, and the temperature of the fixing belt 30 before feeding a sheet to the fixing nip N can be set higher so that a temperature drop of the fixing belt 30 during a sheet feed process can be mitigated. During a sheet feed process, a given amount of electrical power is used by the peripheral unit, by which temperature drop of the fixing belt 30 may occur at some amount.

As such, the fixing process management system 700 can control a given reference temperature used for the "temperature mode" based on connection status of peripheral unit connected to the image forming unit 100. Specifically, the fixing process management system 700 can set a plurality of temperature levels (e.g., two temperature levels) based on the electrical power consumption of the connected peripheral unit. Specifically, if the electrical power consumption of the connected peripheral unit becomes greater, a higher target temperature can be set for the "temperature mode," by which a fixing failure caused by insufficient heat power of the heat source 33 during a sheet feed process can be prevented.

Figure 9:
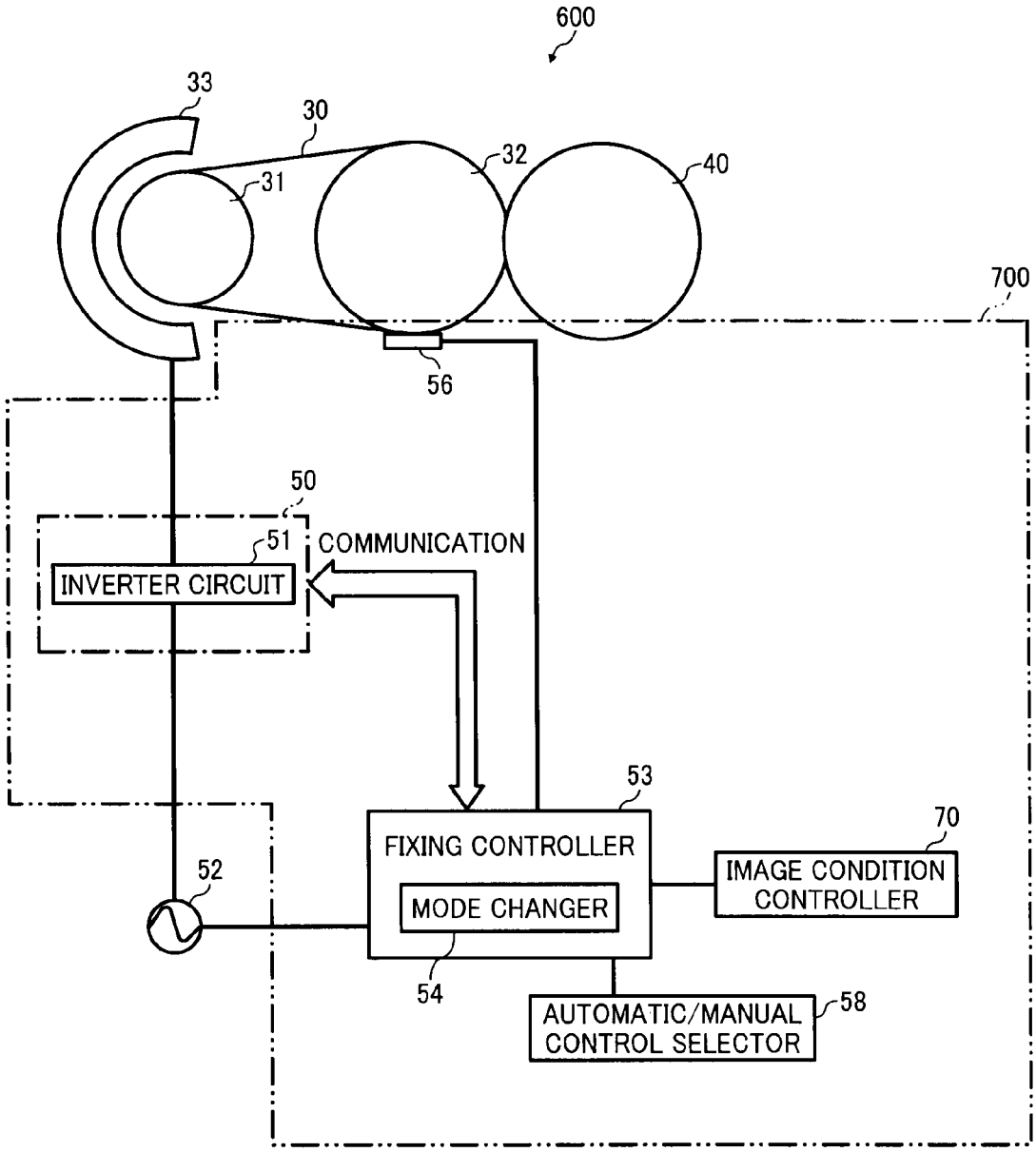
FIG. 9 illustrates a schematic configuration of a fixing unit and another fixing process managing unit of the image forming unit of FIG. 2.

FIG. 9 shows another example of the fixing process management system 700 according to a second exemplary embodiment used with the fixing unit 600 of the image forming unit 100 shown in FIG. 2.

The fixing process management 700 of FIG. 9 includes an image condition controller 70 instead of the peripheral unit detector 55 shown in FIG. 3. The image condition controller 70 detects condition status of image adjustment operation when the activation process of the fixing unit 600 is conducted. Other configuration of the fixing process management 700 of FIG. 9 are same as FIG. 3.

The image forming unit 100 may further includes a timer for counting time-duration of non-operation, and an environment sensor for detecting temperature and humidity, for example. If the image forming unit 100 has not been operated for a given time duration, or if the environment sensor detects a sensor value outside the normal value or range, the image condition controller 70 instructs the image adjustment operation, such as for example an image concentration adjustment operation, and a color-position displacement correction for the image forming engines 10*c*, 10*m*, 10*y*, and 10*k*, when the image forming unit 100 is activated. By conducting the image adjustment operation, an image quality can be maintained, and a higher quality image can be obtained.

With such a configuration, the fixing process management system 700 employs the "time mode" as a standard mode for controlling a warming-up time of the fixing unit 600. In the "time mode," the warming-up time of the fixing unit 600 is set to a given time.

However, when image forming apparatus 100 is activated with the above-described image adjustment operation, electrical power used for the image adjustment operation may become greater. If the electrical power for the image adjustment operation becomes greater, an input electrical power to be used for a fixing process may become lower, and sometimes such input electrical power to be supplied to the fixing unit 600 may become lower than a given electrical power, by which the heat source 33 may not exert enough heat energy required for a fixing process. In such a case, the "time mode" may not be suitable for preparing the fixing unit 600 for the fixing process. Accordingly, instead of the "time mode" which set the waiting time of a user at a substantially constant level, the "temperature mode" is employed because the "temperature mode" determines that the fixing belt 30 is ready for the fixing process after the temperature of the fixing belt 30 becomes a designed fixing temperature required for the fixing process. Accordingly, a fixing failure, caused by a temperature drop of the fixing belt 30 compared to the designed fixing temperature, can be prevented.

The "time mode" and "temperature mode" may be selectively used to reduce the waiting time of a user so that the user may not need to wait a start-up of the image forming apparatus 100 unnecessarily. For example, when the "time mode" is used in a condition that the temperature of the fixing belt 30 can become the designed fixing temperature Tf before the given time (e.g., t1 in FIG. 4) elapses, a user may unnecessarily wait a start-up of the image forming apparatus 100 even if the fixing belt 30 is ready for a fixing process before the given time elapses. Such a situation may occur when the temperature of the fixing belt 30 is still at a higher temperature because the time from the previous fixing process is short to decrease the temperature of the fixing belt 30. In such a case, the "temperature mode" is employed so that the user may not unnecessarily wait the activation process of the fixing unit 600.

Figure 10:
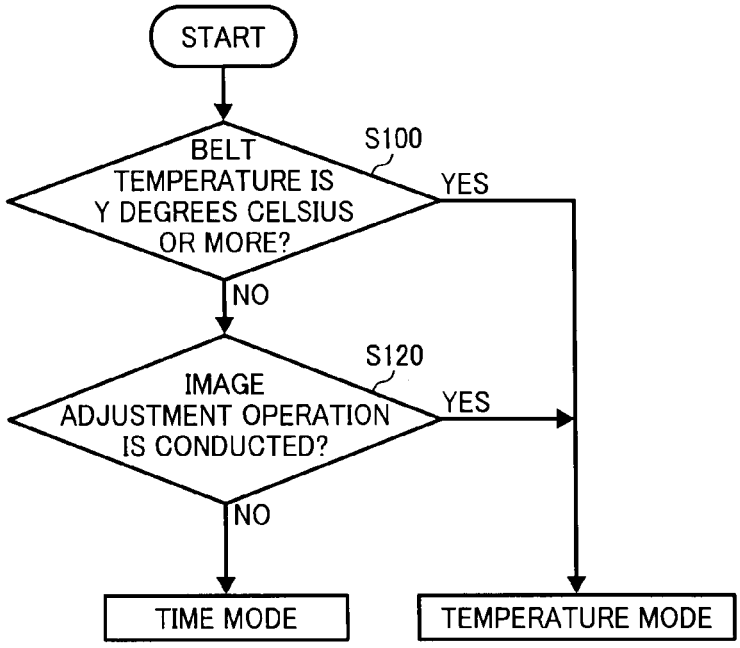
FIG. 10 shows one example flow chart for a method of controlling a warming-up time of the fixing unit of FIG. 9.

FIG. 10 shows another example flow chart for another method of controlling the warming-up time of the fixing unit 600.

As shown in FIG. 10, the belt temperature of the fixing belt 30 is compared with a given reference temperature Y degrees Celcius (e.g., 50 degrees Celcius) at first (step S100).

If the belt temperature is less than the given reference temperature Y degrees Celcius (No at step S100), the image condition controller 70 checks whether the image adjustment operation is conducted (step S120). The mode changer 54 changes the modes based on a detection result by the image condition controller 70.

If the image adjustment operation is not conducted (No at step S120), the "time mode" is employed. If the image adjustment operation is conducted (Yes at step S120), the "temperature mode" is employed because electrical power to be supplied to the fixing unit 600 may become lower than a given electrical power due to the electrical power to be used for the image adjustment operation if "time mode" is employed.

By switching the heating mode to the "temperature mode," the temperature of the fixing belt 30 can be set above a minimum fixing temperature required for a fixing process because a sufficient amount of electrical power can be supplied to the fixing unit 600, by which a fixing failure, caused by a temperature drop of the fixing belt 30 compared to the designed fixing temperature, can be prevented even if electrical power used for the image adjustment operation may become greater. If the "time mode" is employed, the heat source 33 may not exert enough heat energy due to a possible smaller electrical power supply to the fixing unit 600.

The image adjustment operation may include an image concentration adjustment operation, a color-position displacement correction or the like. Type, time duration, timing, and the number of image adjustment operation may vary depending on the non-operated time of the image forming unit 100 and variation of environment condition detected by the environment sensor.

Further the condition status of image adjustment operation for peripheral unit connected to the image forming apparatus 100 may be determined based on type, time duration, timing, and the number of image adjustment operation. Based on such information, electrical power to be supplied to the peripheral unit that needs image adjustment operation can be computed. Accordingly, the electrical power to be supplied to the fixing unit 600 during the activation process can be computed, by which it is determined whether the electrical power to be supplied to the fixing unit 600 is enough or not.

Figure 11:
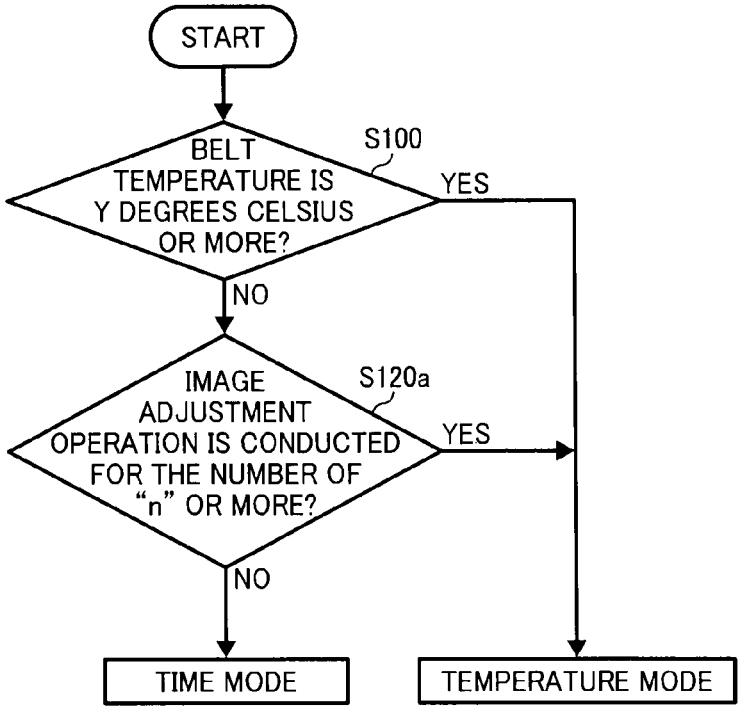
FIG. 11 shows another example flow chart for a method of controlling a warming-up time of the fixing unit of FIG. 9.

FIG. 11 shows another example flow chart for another method of controlling the warming-up time of the fixing unit 600.

As shown in FIG. 11, the belt temperature of the fixing belt 30 is compared with a given reference temperature Y degrees Celcius (e.g., 50 degrees Celcius) at first (step S100).

If the belt temperature is less than the given reference temperature Y degrees Celcius (No at step S100), the image condition controller 70 checks whether the image adjustment operation is conducted for a given number of times "n" or more (step S120*a*).

Specifically, the image condition controller 70 detects how many times the image adjustment operation are conducted, and checks whether the actual operation times is the given number of times "n", and the mode changer 54 changes the heating mode between the "time mode" and "temperature mode" based on a detection result of the number of times of the image adjustment operation. If the number of times of the image adjustment operation is less than the given number of times "n" (No at step S120*a*), the "time mode" is employed, and if the number of times of the image adjustment operation is "n" or more (Yes at step S120*a*), the "temperature mode" is employed.

By switching the mode to the "temperature mode," the temperature of the fixing belt 30 can be set above a minimum fixing temperature required for a fixing process because a sufficient amount of electrical power can be supplied to the fixing unit 600, by which, a fixing failure, caused by a temperature drop of the fixing belt 30 compared to the designed fixing temperature, can be prevented even if electrical power used for the image adjustment operation may become greater. If the "time mode" is employed, the heat source 33 may not exert enough heat energy due to a smaller electrical power supply to the fixing unit 600.

Figure 12:
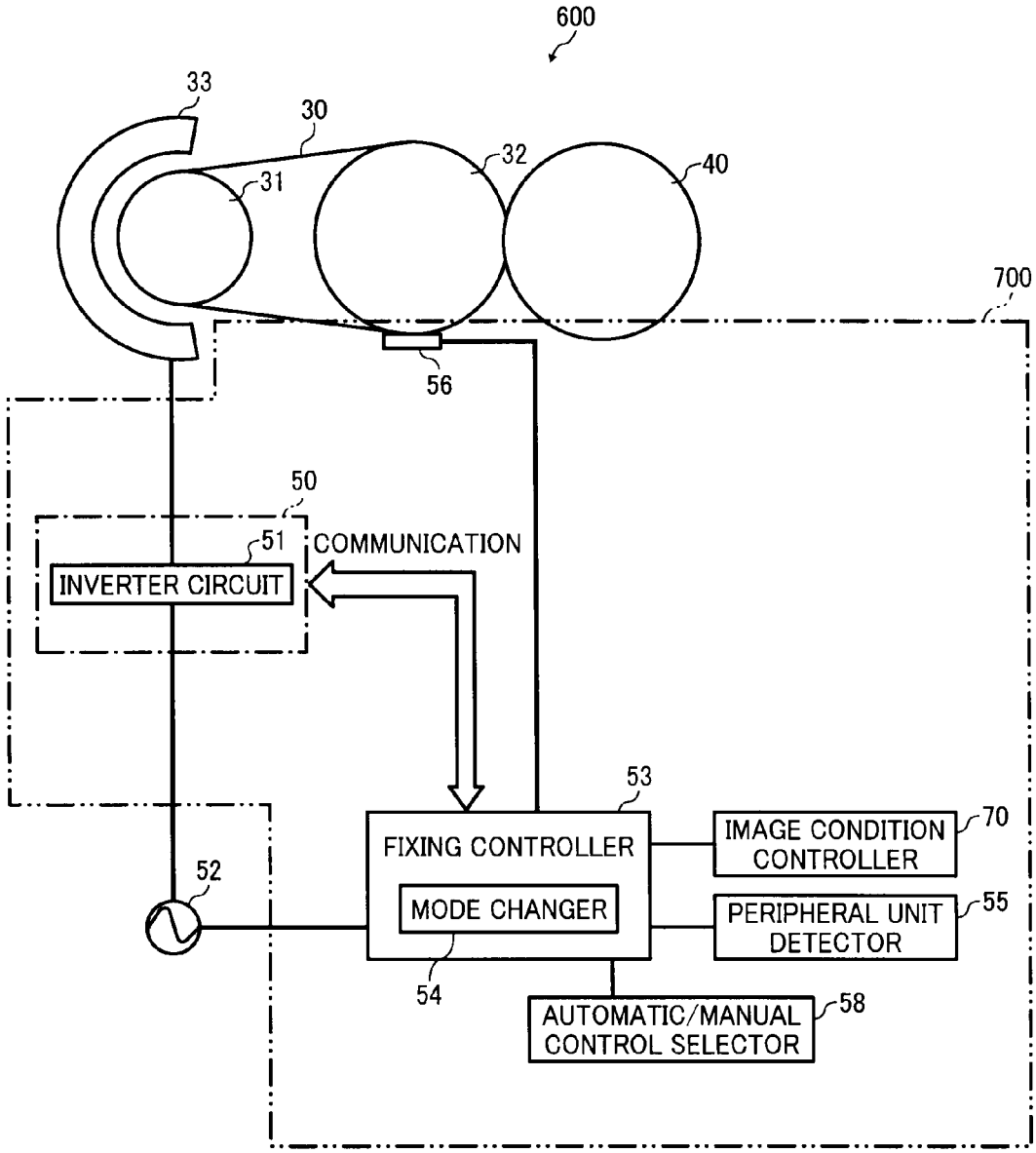
FIG. 12 illustrates a schematic configuration of a fixing unit and another fixing process managing unit of the image forming unit of FIG. 2.

FIG. 12 shows another example of the fixing process management system 700 according to a third exemplary embodiment used with the fixing unit 600 of the image forming unit 100 shown in FIG. 2.

The fixing process management 700 of FIG. 12 further includes the image condition controller 70 added to the configuration of FIG. 3. The image condition controller 70 is connected to the fixing controller 53. The image condition controller 70 detects condition status of image adjustment operation when the activation process of the fixing unit 600 is conducted. Other configuration of the fixing process management 700 of FIG. 12 are same as FIG. 3.

In such a configuration, the fixing process management system 700 uses two factors to determine whether the electrical power to be supplied to the fixing unit 600 becomes less than a given reference electrical power.

Specifically, the fixing process management system 700 detects: 1) a connection status of peripheral unit connected to the image forming unit 100; and 2) condition status of image adjustment operation when the activation process of the fixing unit 600 is conducted to determine the electrical power amount to be supplied to the fixing unit 600.

With such a configuration, the fixing unit 600 can be controlled more precisely, and the temperature of the fixing belt 30 can be set above a minimum fixing temperature required for a fixing process because a sufficient amount of electrical power can be supplied to the fixing unit 600, by which a fixing failure, caused by a temperature drop of the fixing belt 30 compared to the designed fixing temperature, can be prevented even if electrical power used for the image adjustment operation may become greater.

Figure 13:
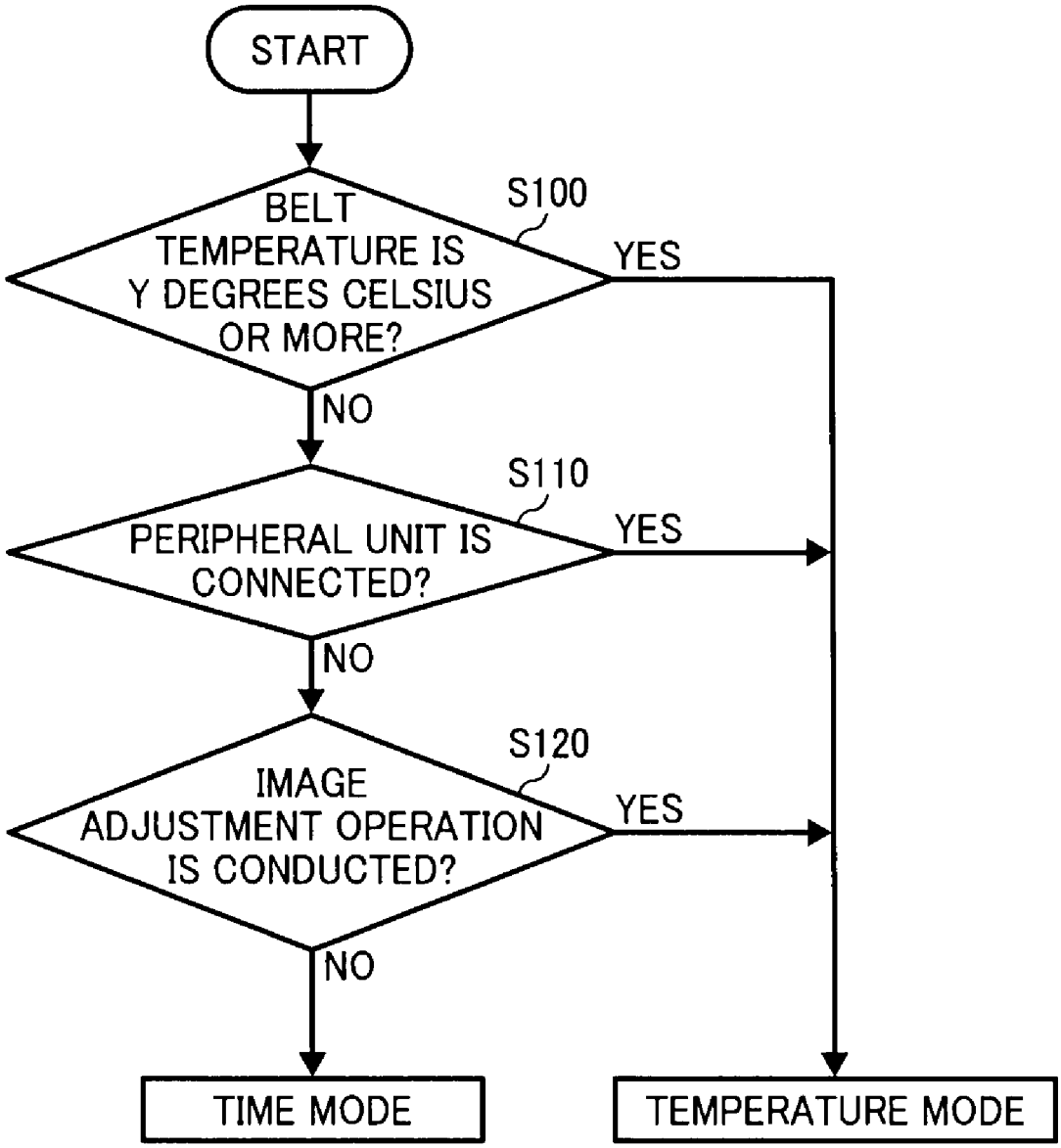
FIG. 13 shows one example flow chart for a method of controlling a warming-up time of the fixing unit of FIG. 12.

FIG. 13 shows another example flow chart for another method of controlling the warming-up time of the fixing unit 600.

As shown in FIG. 13, the belt temperature of the fixing belt 30 is compared with a given reference temperature Y degrees Celcius (e.g., 50 degrees Celcius) at first (step S100). If the belt temperature is the given reference temperature Y degrees Celcius or more (Yes at step S100), the "temperature mode" is employed. If the belt temperature is less than the given reference temperature Y degrees Celcius (No at step S100), the peripheral unit detector 55 checks whether a peripheral unit (e.g., finisher 500, ADF 300) is connected to the image forming apparatus 100 (step S110).

If the peripheral unit detector 55 detects that a peripheral unit is connected (Yes at step S110), the "temperature mode" is selected by the mode changer 54. If the peripheral unit detector 55 detects that a peripheral unit is not connected (No at step S110), the image condition controller 70 checks whether the image adjustment operation is conducted (step S120).

If the image condition controller 70 detects that the image adjustment operation is conducted (Yes at step S120), the "temperature mode" is selected by the mode changer 54. If the image condition controller 70 detects that the image adjustment operation is not conducted (No at step S120), the "time mode" is selected by the mode changer 54.

In the above described exemplary embodiments, the fixing process management system 700 determines whether electrical power to be supplied to the fixing unit 600 is less than a given level or amount of electrical power based on a connection status of peripheral unit connected to the image forming unit 100, and condition status of image adjustment operation when the activation process of the fixing unit 600 is conducted.

However, the fixing process management system 700 can determine whether electrical power to be supplied to the fixing unit 600 is less than a given level or amount of electrical power based on other criteria or factor. For example, a voltage value of the commercial power source 52 can be used as a criteria or factor as follow.

Specifically, the fixing process management system 700 can determine whether electrical power to be supplied to the fixing unit 600 is less than a given level or amount of electrical power based on a voltage value input from the commercial power source 52 when the activation process of the fixing unit 600 is conducted.

If it is determined that an input voltage value from the commercial power source 52 is too low to supply enough electrical power to the fixing unit 600, the "time mode" is not employed but the "temperature mode" is employed because a lower input voltage (or electrical power) means that the heat source 33 can not generate enough heating power.

In the "temperature mode," it is determined that a fixing process can be conducted when the temperature of the fixing belt 30 becomes the designed fixing temperature required for the fixing process, by which a fixing failure, caused by a temperature drop of the fixing belt 30 compared to the designed fixing temperature, can be prevented.

Figure 14:
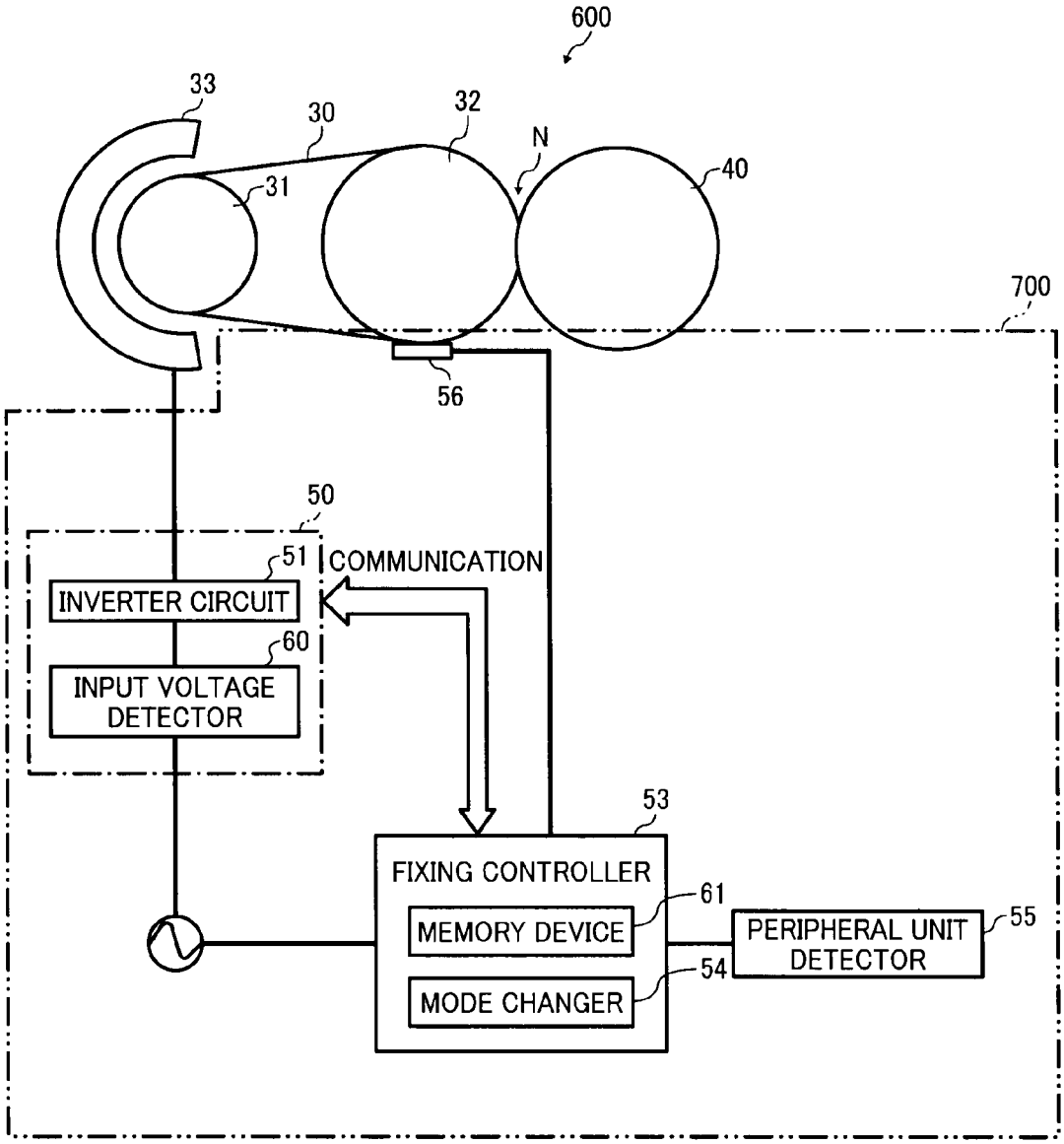
FIG. 14 illustrates a schematic configuration of a fixing unit and another fixing process managing unit of the image forming unit of FIG. 2.

FIG. 14 shows another example of the fixing process management system 700 according to a fourth embodiment used with the fixing unit 600 of the image forming unit 100 shown in FIG. 2.

The fixing unit 600 includes the fixing belt 30, which may be an endless belt and extended and looped by the first roller 31 and the second roller 32, in which one of the first and second rollers 31 and 32 is used as a drive roller and the other is used as a driven roller. The fixing belt 30 can be traveled in a given direction by rotating the first and second rollers 31 and 32 (i.e., drive and driven rollers). Further, the heat source 33 may be disposed near the first roller 31 to heat the fixing belt 30, and the pressure roller 40 is pressed against the second roller 32 via the fixing belt 30 to form the fixing nip N. The heat source 33 may be an induction heating coil (IH coil), which can heat the fixing belt 30 by using electromagnetic induction, for example.

When the recording medium P passes through the fixing nip N, pressure and heat are applied to the recording medium P to fix an image on the recording medium P. Specifically, the pressure is applied to the recording medium P by pressing the pressure roller 40 against the second roller 32 via the fixing belt 30, and the heat is applied to the recording medium P by heating the fixing belt 30 by energizing the heat source 33 (IH coil) using electromagnetic induction.

The heat source 33 of the fixing unit 600 can be controlled by the fixing process management system 700. The fixing process management system 700 includes the IH controller 50 connected to the heat source 33. The IH controller 50 includes the inverter circuit 51 and an input voltage detector 60. The IH controller 50 is connected to the fixing controller 53 for communicating information each other. The fixing controller 53 includes the mode changer 54 and a memory device 61, and is connected to the peripheral unit detector 55. The peripheral unit detector 55 detects connection status of peripheral unit, such as for example finisher 500 and ADF 300, using electric signals.

The mode changer 54 is used to select one of the "temperature mode" and the "time mode" to set the temperature of the fixing belt 30 to a fixing temperature when the activation process of the fixing unit 600 is conducted.

In the "temperature mode," it is determined that a fixing process can be effectively conducted when the temperature of the fixing belt 30 becomes a given value. For example, when the temperature of the fixing belt 30 is increased to a designed fixing temperature, it is determined that a fixing process can be effectively conducted.

In "time mode," it is determined that a fixing process can be effectively conducted when a given time lapses after the activation process of the fixing unit 600 is started.

The fixing controller 53 is connected to the thermistor 56, which detects the temperature of the fixing belt 30. Further, the fixing controller 53 and the IH controller 50 are connected to the commercial power source 52.

The fixing process management system 700 controls the heating mode of the fixing belt 30 heated by the heat source 33 of the fixing unit 600. The fixing process management system 700 may set the "time mode" as a first priority mode and the "temperature mode" as a second priority mode, in which the "time mode" is used as a standard mode for the heating mode. However, if it is determined that the "time mode" may cause a fixing failure, the mode changer 54 changes the heating mode from the "time mode" to the "temperature mode." For example, if it is determined that an electric power supply to the fixing unit 600 becomes lower than a desired power supply for the activation process of the fixing unit 600, the heating mode is changed to the "temperature mode" from the "time mode."

Figure 15:
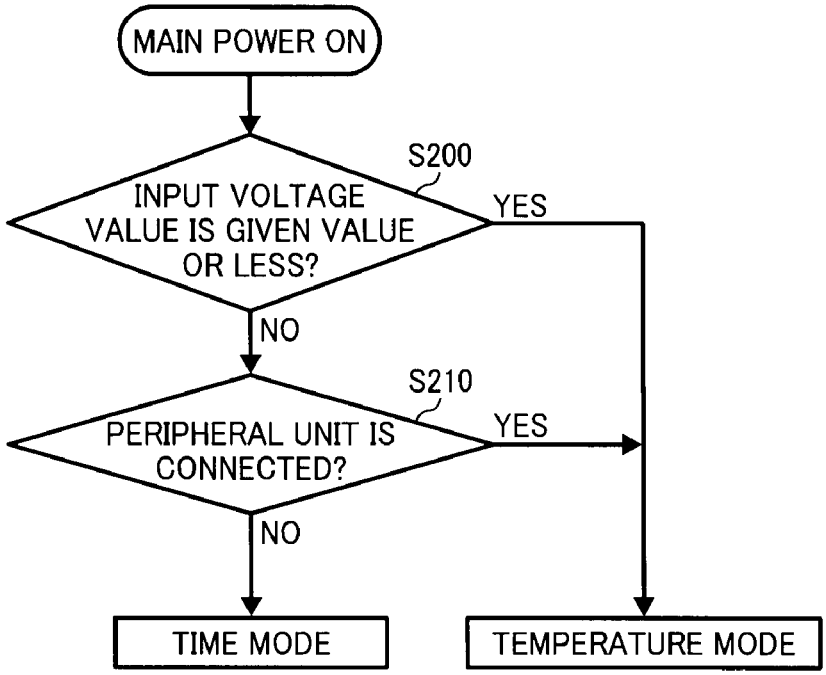
FIG. 15 shows one example flow chart for a method of controlling a warming-up time of the fixing unit of FIG. 14.

FIG. 15 shows another example flow chart for another method of controlling the warming-up time of the fixing unit 600.

Electrical power to be used for initializing a peripheral unit is computed based on information of peripheral unit detected by the peripheral unit detector 55.

At step S200, an input voltage value of the commercial power source 52 detected by the input voltage detector 60 is compared with a given value. If the input voltage value is less than the given value (Yes at step S200), the "temperature mode" is employed.

If the voltage value is the given value or more (No at step S200), it is checked whether a peripheral unit is connected to the image forming apparatus 100 at step S210.

If the peripheral unit is not connected (No at step S210), the "time mode" is employed to set a warming-up time of the fixing unit 600 at a constant time level. If the peripheral unit is connected (Yes at step S210), the "temperature mode" is employed.

If it is determined that the heat source 33 becomes short of electrical power for effectively conducting the fixing process, the heating mode is changed from the "time mode" to the "temperature mode." Such a situation may be determined by detecting a connection status of the peripheral unit and the voltage value of the commercial power source 52.

For example, under some connection status of the peripheral units, the fixing unit 600 may not be supplied with electrical power required for a fixing process from the single power source because the same single power source supplies electrical power used for the initialization process of the peripheral unit.

Further, under some condition, the voltage value of the commercial power source 52 detected by the input voltage detector 60 becomes less than the given value. In such conditions, instead of the "time mode," the "temperature mode" is employed in which it is determined that a fixing process can be conducted when the temperature of the fixing belt 30 becomes the designed fixing temperature required for the fixing process, by which a fixing failure, caused by a temperature drop of the fixing belt 30 compared to the designed fixing temperature during a sheet feed process, can be prevented.

Figure 16:
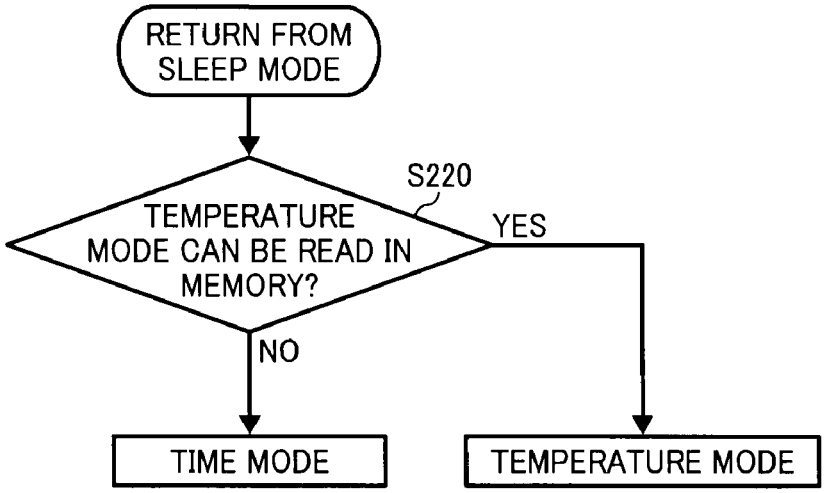
FIG. 16 shows another example flow chart for a method of controlling a warming-up time of the fixing unit of FIG. 14.

FIG. 16 shows another example flow chart for another method of controlling the warming-up time of the fixing unit 600, in which the image forming apparatus 100 is activated or returned from a sleep mode. In general, when the image forming apparatus 100 enters the sleep mode, the connection status information of peripheral unit and the input voltage information may be reset. Accordingly, when the image forming apparatus 100 returns from the sleep mode, the connection status information of peripheral unit and the input voltage information may need to be detected every time the image forming apparatus 100 is activated again.

In a configuration of FIG. 14, the connection status information of peripheral unit and the input voltage information can be stored in the memory device 61 while a main power is ON. When the image forming apparatus 100 returns from the sleep mode, the "time mode" and "temperature mode" can be selected based on the information stored in the memory device 61 (step S220 in FIG. 16) without a detection process of connection status of peripheral unit and the input voltage, by which a warming-up time of the image forming apparatus 100 can be reduced because the detection of such information can be conducted with reduced time.

Figure 17:
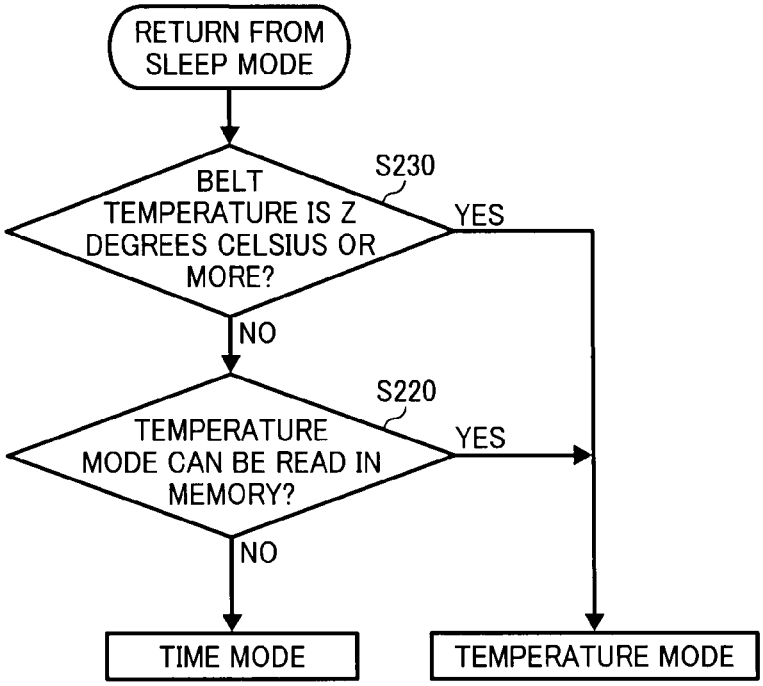
FIG. 17 shows another example flow chart for a method of controlling a warming-up time of the fixing unit of FIG. 14.

FIG. 17 shows another example flow chart for another method of controlling the warming-up time of the fixing unit 600, in which the image forming apparatus 100 is activated or returned from the sleep mode but the temperature of the fixing belt 30 is still greater than a given reference temperature Z degrees Celcius (e.g., 60 degrees Celcius) because the image forming apparatus 100 is activated again in a relatively short period of time from the previous fixing process or image forming process.

If the temperature of the fixing belt 30 is still in the given reference temperature Z degrees Celcius or more (Yes at step S230), the "temperature mode" is employed. With such a configuration, the activation process of the fixing unit 600 can be conducted in a reduced time.

Further if the temperature of the fixing belt 30 is less than the given reference temperature Z degrees Celcius (No at step S230), the information stored in the memory device 61 is checked (step S220). If the "temperature mode" is stored in the memory device 61 (Yes at Step 220), the "temperature mode" may be employed.

During such process, information of the connection status of the peripheral unit and the input voltage information of the power source may also be used.

Figure 18:
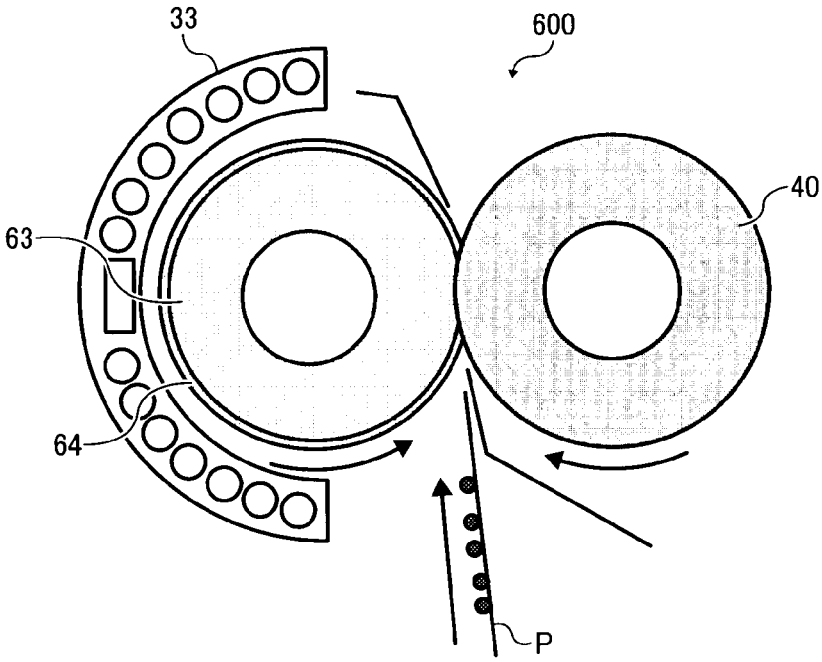
FIG. 18 illustrates a schematic configuration of another fixing unit using a roller heated by an induction heating coil (IH coil).

In the above-described exemplary embodiments, the fixing unit 600 includes the heat source 33 using an IH coil, and the fixing belt 30 as a fixing member. However, other configuration can be devised for the fixing unit 600. For example, as shown in FIG. 18, the fixing unit 600 may include a fixing roller 63 having a metal layer 64 on its surface or sub-surface area. The metal layer 64 can be heated by using an inverter.

Further, a pressing member pressed against the fixing member may not be limited to the pressure roller 40, but other members can be used. For example, a pressure belt extended by rollers, a not-tensioned belt, and a pressure pad that does not rotate or move can be used.

Further, the heat source can be disposed outside or inside of the fixing belt 30; the heat source can be disposed inside the first roller 31; or the heat sources can be disposed both for the fixing belt 30 and the first roller 31. Further, if the fixing member is a fixing roller, the heat source can be disposed inside the fixing roller. Further, the heat source can be disposed for the pressing member.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus comprising:

a fixing unit comprising a fixing member and a pressing member pressed against the fixing member to fix a toner image on a recording medium passed between the fixing member and the pressing member by applying heat and pressure to the toner image on the recording medium using the fixing member and the pressing member in a fixing process; and a fixing process managing system that controls heating of the fixing member by selectively switching between a time mode and a temperature mode, the fixing unit being ready for a fixing process when a given time elapses after activation of the image forming apparatus in the time mode, the fixing unit being ready for a fixing process when a temperature of the fixing member attains a given reference temperature after activation of the image forming apparatus in the temperature mode, the fixing process managing system comprising a mode switchover unit configured to select one of the temperature mode and the time mode for the fixing unit, the fixing process managing system selecting the temperature mode instead of the time mode when a supply amount of electrical power to be supplied to the fixing unit when activating the image forming apparatus falls below a required level of electrical power supply.

2. The image forming apparatus according to claim 1, wherein the fixing process managing system comprises a peripheral unit detector configured to detect a connection status of a peripheral unit.

3. The image forming apparatus according to claim 2, wherein the fixing process managing system determines whether the supply amount of electrical power to be supplied to the fixing unit when activating the image forming apparatus falls below the required level of electrical power supply based on the connection status of the peripheral unit connected to the image forming apparatus detected by the peripheral unit detector.

4. The image forming apparatus according to claim 2, wherein the connection status of the peripheral unit includes at least one of type and number of the peripheral unit connected to the image forming apparatus.

5. The image forming apparatus according to claim 2, wherein the connection status of the peripheral unit includes accumulated electric power consumption of the peripheral unit connected to the image forming apparatus.

6. The image forming apparatus according to claim 2, wherein the fixing process managing system controls the given time set for the time mode based on the connection status of the peripheral unit connected to the image forming apparatus.

7. The image forming apparatus according to claim 2, wherein the fixing process managing system controls the given reference temperature set for the temperature mode based on the connection status of the peripheral unit connected to the image forming apparatus.

8. The image forming apparatus according to claim 2, wherein the fixing process managing system determines whether the supply amount of electrical power to be supplied to the fixing unit when activating the image forming apparatus falls below the required level of electrical power supply based on the connection status of the peripheral unit connected to the image forming apparatus and further based on input voltage input to the image forming apparatus.

9. The image forming apparatus according to claim 8, further comprising a memory device configured to store data on the connection status of the peripheral unit connected to the image forming apparatus and data on the input voltage input to the image forming apparatus while a main power is supplied to the image forming apparatus.

10. The image forming apparatus according to claim 1, wherein the fixing process managing system determines whether the supply amount of electrical power to be supplied to the fixing unit when activating the image forming apparatus falls below the required level of electrical power supply based on a condition status of an image adjustment operation when activating the image forming apparatus.

11. The image forming apparatus according to claim 10, wherein the fixing process managing system comprises an image condition controller configured to detect the condition status of an image adjustment operation when activating the image forming apparatus.

12. The image forming apparatus according to claim 10, wherein the condition status of the image adjustment operation includes at least one of type, number, and duration of the image adjustment operation.

13. The image forming apparatus according to claim 10, wherein the fixing process managing system determines whether the supply amount of electrical power to be supplied to the fixing unit when activating the image forming apparatus falls below the required level of electrical power supply based on the connection status of the peripheral unit connected to the image forming apparatus and further based on the condition status of the image adjustment operation when activating the image forming apparatus.

14. The image forming apparatus according to claim 1, wherein the fixing process managing system determines whether the supply amount of electrical power to be supplied to the fixing unit when activating the image forming apparatus falls below the required level of electrical power supply based on a voltage value of a commercial power source used for supplying power to the image forming apparatus.

15. A method of controlling a warming-up time of an image forming apparatus including a fixing unit including a fixing member and a pressing member pressed against the fixing member to fix a toner image on a recording medium passed between the fixing member and the pressing member by applying heat and pressure to the toner image on the recording medium using the fixing member and the pressing member in a fixing process, the method comprising:

determining a supply amount of electrical power to be supplied to the fixing unit when activating the image forming apparatus; and selecting one of a time mode and a temperature mode after determining the supply amount electrical power to be supplied to the fixing unit, a fixing process being ready when a given time elapses after activation of the image forming apparatus in the time mode, a fixing process being ready when a temperature of the fixing member becomes a given reference temperature in the temperature mode, the selecting comprising selecting the temperature mode instead of the time mode when the supply amount of the electrical power to be supplied to the fixing unit when warming-up the image forming apparatus falls below a required level of electrical power supply.

* * * * *